US007018157B2

(12) United States Patent
Gallant et al.

(10) Patent No.: US 7,018,157 B2
(45) Date of Patent: Mar. 28, 2006

(54) POWERED TRANSPORT APPARATUS FOR A BED

(75) Inventors: Dennis J. Gallant, Harrison, OH (US); John D. Vogel, Columbus, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 237 days.

(21) Appl. No.: 10/247,405

(22) Filed: Sep. 19, 2002

(65) Prior Publication Data

US 2003/0097712 A1 May 29, 2003

Related U.S. Application Data

(60) Provisional application No. 60/323,747, filed on Sep. 20, 2001.

(51) Int. Cl.
*A47C 21/00* (2006.01)

(52) U.S. Cl. ..... 414/495; 5/510; 180/19.1

(58) Field of Classification Search ..... 280/124.116; 5/510; 414/495; 180/19.1
See application file for complete search history.

(56) References Cited

U.S. PATENT DOCUMENTS

| | | | | |
|---|---|---|---|---|
| 813,213 | A | | 2/1906 | Johnson |
| 1,110,838 | A | | 9/1914 | Taylor |
| 1,118,931 | A | | 12/1914 | Hasley |
| 1,598,124 | A | | 8/1926 | Evans |
| 1,639,801 | A | | 8/1927 | Heise |
| 1,778,698 | A | | 10/1930 | Walter |
| 2,224,087 | A | | 12/1940 | Reichert |
| 2,599,717 | A | | 6/1952 | Menzies |
| 2,635,899 | A | | 4/1953 | Osbon, Jr. |
| 2,999,555 | A | | 9/1961 | Stroud et al. |
| 3,004,768 | A | | 10/1961 | Klages |
| 3,112,001 | A | | 11/1963 | Wise |
| 3,239,019 | A | * | 3/1966 | Ida ..... 180/200 |
| 3,304,116 | A | | 2/1967 | Stryker |
| 3,305,876 | A | | 2/1967 | Hutt |
| 3,380,546 | A | | 4/1968 | Rabjohn |
| 3,393,004 | A | | 7/1968 | Williams |
| 3,452,371 | A | | 7/1969 | Hirsch |
| 3,544,127 | A | | 12/1970 | Dobson |
| 3,618,966 | A | | 11/1971 | Banderves |
| 3,680,880 | A | | 8/1972 | Blaauw |
| 3,770,070 | A | | 11/1973 | Smith |
| 3,814,199 | A | | 6/1974 | Jones |
| 3,820,838 | A | | 6/1974 | Limpach |
| 3,876,024 | A | | 4/1975 | Shieman et al. |
| 4,137,984 | A | | 2/1979 | Jennings |
| 4,164,355 | A | | 8/1979 | Eaton |
| 4,167,221 | A | | 9/1979 | Edmonson |

(Continued)

FOREIGN PATENT DOCUMENTS

CA 2010543 9/1990

(Continued)

OTHER PUBLICATIONS

Stryker Medical, 2040 Zoom™ Critical Care Bed Maintenance Manual, date unknown.

(Continued)

*Primary Examiner*—Thomas J. Brahan
(74) *Attorney, Agent, or Firm*—Bose McKinney & Evans LLP

(57) ABSTRACT

A patient support and powered transport apparatus are provided. The powered transport apparatus is provided to assist a caregiver in moving the patient support from one location in a care facility to another.

35 Claims, 16 Drawing Sheets

U.S. PATENT DOCUMENTS 4,175,632 A 11/1979 Lassanlke
4,175,783 A 11/1979 Pioth
4,274,503 A 6/1981 Mackintosh
4,275,797 A 6/1981 Johnson
4,415,049 A 11/1983 Wereb
4,415,050 A 11/1983 Nishida
4,439,879 A 4/1984 Werner
4,444,284 A 4/1984 Montemurro
4,475,611 A 10/1984 Fisher
4,475,613 A 10/1984 Walker
4,513,832 A 4/1985 Engman
4,566,707 A 1/1986 Nitzberg
4,584,989 A 4/1986 Stith
4,629,242 A 12/1986 Schrager
4,723,808 A 2/1988 Hines
4,724,555 A 2/1988 Poehner
4,759,418 A 7/1988 Goldenfeld et al.
4,771,840 A 9/1988 Keller
4,807,716 A 2/1989 Hawkins
4,811,988 A 3/1989 Immel
4,895,040 A 1/1990 Soederberg
4,922,574 A 5/1990 Heiligenthal et al.
4,938,493 A 7/1990 Okuda
4,949,408 A 8/1990 Trkla
4,979,582 A 12/1990 Forster
4,981,309 A 1/1991 Froeschle
5,060,327 A 10/1991 Celestina et al.
5,060,959 A 10/1991 Davis et al.
5,069,465 A 12/1991 Stryker et al.
5,083,625 A 1/1992 Bleicher
5,084,922 A 2/1992 Louit
5,094,314 A 3/1992 Hayata
5,117,521 A 6/1992 Foster et al.
5,121,806 A 6/1992 Johnson
5,156,226 A 10/1992 Boyer et al.
5,181,762 A 1/1993 Beumer
5,187,824 A 2/1993 Stryker
5,201,819 A 4/1993 Shiraishi et al.
5,222,567 A 6/1993 Broadhead et al.
5,232,065 A 8/1993 Cotton
5,244,225 A 9/1993 Frycek
5,251,429 A 10/1993 Minato et al.
5,255,403 A 10/1993 Ortiz
5,279,010 A 1/1994 Ferrand et al.
5,284,218 A 2/1994 Rusher, Jr.
5,293,950 A 3/1994 Marliac
5,307,889 A 5/1994 Bohannan
5,322,306 A 6/1994 Coleman
5,337,845 A 8/1994 Foster et al.
5,348,326 A 9/1994 Fullenkamp et al.
5,358,265 A 10/1994 Yaple
5,366,036 A 11/1994 Perry
5,381,572 A 1/1995 Park
5,388,294 A 2/1995 Reeder
5,406,778 A 4/1995 Lamb et al.
5,439,069 A 8/1995 Beeler
5,445,233 A 8/1995 Fernie et al.
5,447,317 A 9/1995 Gehlsen et al.
5,477,935 A 12/1995 Chen
5,495,904 A 3/1996 Zwaan et al.
5,526,890 A 6/1996 Kadowaki
5,535,465 A 7/1996 Hannant
5,562,091 A 10/1996 Foster et al.
5,570,483 A 11/1996 Williamson
5,580,207 A 12/1996 Kiebooms et al.
5,613,252 A 3/1997 Yu et al.
5,651,149 A 7/1997 Garman
5,669,086 A 9/1997 Garman
5,687,437 A 11/1997 Goldsmith
5,690,185 A 11/1997 Sengel
5,697,623 A 12/1997 Bermes et al.
5,737,782 A 4/1998 Matsuura et al.
5,749,424 A 5/1998 Reimers
5,762,155 A * 6/1998 Scheulderman ..... 180/65.1
5,775,456 A 7/1998 Reppas
5,806,111 A 9/1998 Heimbrock et al.
5,809,755 A 9/1998 Velke et al.
5,839,528 A 11/1998 Lee
5,884,720 A * 3/1999 Ackerman ..... 180/199
5,906,017 A 5/1999 Ferrand et al.
5,915,487 A 6/1999 Splittstoesser et al.
5,921,338 A 7/1999 Edmondson
5,934,694 A 8/1999 Schugt et al.
5,937,961 A 8/1999 Davidson
5,964,313 A 10/1999 Guy
5,971,091 A 10/1999 Kamen et al.
5,983,425 A 11/1999 DiMucci et al.
5,987,671 A 11/1999 Heimbrock et al.
5,988,304 A 11/1999 Behrendts
5,996,149 A 12/1999 Heimbrock et al.
6,016,580 A 1/2000 Heimbrock et al.
6,035,561 A 3/2000 Paytas et al.
6,059,060 A 5/2000 Kanno et al.
6,059,301 A 5/2000 Skarnulis
6,062,328 A 5/2000 Campbell et al.
6,065,555 A 5/2000 Yuki et al.
6,070,679 A 6/2000 Berg et al.
6,073,285 A 6/2000 Ambach et al.
6,076,208 A 6/2000 Heimbrock et al.
6,076,209 A 6/2000 Paul
6,105,348 A 8/2000 Turk et al.
6,125,957 A 10/2000 Kauffmann
6,131,690 A 10/2000 Galando et al.
6,148,942 A 11/2000 Mackert, Sr.
6,173,799 B1 1/2001 Miyazaki et al.
6,178,575 B1 1/2001 Harada
6,179,074 B1 1/2001 Scharf
6,256,812 B1 7/2001 Bartow et al.
6,390,213 B1 * 5/2002 Bleicher ..... 180/65.1
2002/0029418 A1 3/2002 Votel

FOREIGN PATENT DOCUMENTS

DE 1960444 9/1970
DE 31 19 524 * 12/1982
DE 3500212 A1 7/1985
DE 9420429 U 12/1996
DE 29518502 U 1/1997
DE 19921503 A1 4/2000
EP 0093700 A2 11/1983
EP 0420263 A1 4/1991
EP 0630637 12/1994
EP 0630637 A1 12/1994
EP 0776637 6/1997
EP 0776648 6/1997
FR 2 680 493 * 8/1992
FR 2714008 12/1996
FR 2735019 12/1996
FR 2 746 060 9/1997
GB 672557 5/1952
GB 2285393 7/1995
GB 2285393 A 7/1995
JP 46-31490 9/1971
JP 47-814 8/1972
JP 47-17495 10/1972
JP 48-44792 6/1973
JP 48-44793 6/1973
JP 48-54494 7/1973
JP 48-54495 7/1973
JP 49-29855 3/1974
JP 51-20491 2/1976
JP 53-9091 1/1978
JP 53-96397 8/1978
JP 56-68523 6/1981

| | | | |
|---|---|---|---|
| JP | 56-68524 | | 6/1981 |
| JP | 56-73822 | | 6/1981 |
| JP | 57-157325 | | 10/1982 |
| JP | 57-187521 | | 11/1982 |
| JP | 58-63575 | | 4/1983 |
| JP | 59-37946 | | 3/1984 |
| JP | 59-38176 | | 3/1984 |
| JP | 59-183756 | | 10/1984 |
| JP | 59-186554 | | 10/1984 |
| JP | 60-12058 | | 1/1985 |
| JP | 60-12059 | | 1/1985 |
| JP | 60-21751 | | 2/1985 |
| JP | 60-31749 | | 2/1985 |
| JP | 60-31750 | | 2/1985 |
| JP | 60-31751 | | 2/1985 |
| JP | 60-122561 | | 7/1985 |
| JP | 60-188152 | | 9/1985 |
| JP | 60-188153 | | 9/1985 |
| JP | 61-188727 | | 11/1986 |
| JP | 62-60433 | | 4/1987 |
| JP | 64-17231 | | 1/1989 |
| JP | 2-84961 | A | 3/1990 |
| JP | 3-31063 | | 2/1991 |
| JP | 4-108525 | | 9/1992 |
| JP | 6-50631 | | 7/1994 |
| JP | 6-237959 | | 8/1994 |
| JP | 7-136215 | | 5/1995 |
| JP | 7-328074 | | 12/1995 |
| JP | 8-112244 | | 5/1996 |
| JP | 8-317953 | A | 12/1996 |
| JP | 9-24071 | | 1/1997 |
| JP | 9-38154 | A | 2/1997 |
| JP | 9-38155 | A | 2/1997 |
| JP | 10-146364 | A | 8/1998 |
| JP | 2000-107230 | | 4/2000 |
| JP | 2000-175974 | | 6/2000 |
| WO | WO82/01313 | | 4/1982 |
| WO | WO94/16935 | | 8/1994 |
| WO | WO96/13239 | | 5/1996 |
| WO | WO97/39715 | | 10/1997 |
| WO | WO00/37222 | | 6/2000 |
| WO | WO00/51830 | | 9/2000 |
| WO | WO00/59441 | | 10/2000 |
| WO | WO01/19313 | A1 | 3/2001 |

OTHER PUBLICATIONS

Motorvator 3 Product Features Webpage, May 10, 2000.
Stryker Corporation, Zoom™ Drive brochure, Mar. 2000.
Midmark 530 Stretcher Information, Midmark Catalog, p. 14.
Hill-Rom On3 Product Brochure 2000.

* cited by examiner

POWERED TRANSPORT APPARATUS FOR A BED

This application claims priority to U.S. Provisional Patent Application No. 60/323,747, to Gallant, et al., filed Sep. 20, 2001, the disclosure of which is expressly incorporated by reference herein.

BACKGROUND OF THE INVENTION

This invention relates to patient supports, such as hospital beds, gurneys, and the like. More particularly, the present invention relates to apparatus for assisting caregivers in moving patient supports from one location in a care facility to another.

Different types of tables, beds, and other patient supports are well known in the health care industry for supporting patients during surgical procedures and for supporting patients generally while in a hospital, nursing home, home, or the like. Patient supports typically are capable of supporting a maximum patient weight of about six hundred pounds and the patient supports themselves often weight hundreds or thousands of pounds. Thus, it can often be difficult for a caregiver to move a patient on a patient support from one location in a care facility to another because of these combined weights.

According to the present invention, a powered transport apparatus is provided that is configured to provide powered transport of a patient support. The patient support has head and foot ends and first and second longitudinal sides extending between the head and foot ends. The powered transport apparatus includes a frame adapted to be positioned under the patient support by entering one of the longitudinal sides of the patient support; a powered wheel rotatably supported by the frame to provide powered transport of the patient support; a scissor mechanism supported by the frame and configured to transfer downward force from the patient support to the powered wheel; and a connection member supported by the scissor mechanism and configured to removably connect to the patient support. The scissor mechanism is movable between a first position transferring downward force from the patient support to the powered wheel and a second position permitting removal of the frame from the patient support.

According to another aspect of the present invention, a powered transport apparatus is provided that is configured to provide powered transport of a patient support. The patient support has head and foot ends and first and second longitudinal sides extending between the head and foot ends. The powered transport apparatus includes a frame adapted to be removably connected to the patient support from at least one of the first and second longitudinal sides of the patient support and a powered wheel rotatably connected to the frame to provide powered transport of the patient support.

According to another aspect of the present invention, a powered transport apparatus is provided that is configured to provide powered transport of a patient support. The powered transport apparatus includes a frame, a powered wheel, and a scissor mechanism supported by the frame and movable between a first position supporting the patient support and a second position permitting removal of the frame from the patient support.

According to another aspect of the present invention, a powered transport apparatus is provided that is configured to provide powered transport of a patient support having a frame with at least two longitudinally extending members.

The powered transport apparatus includes a frame, a powered wheel supported by the frame, and a connection member supported by the frame. The connection member is adapted to connect to the at least two longitudinally extending members of the patient support.

According to another aspect of the present invention, a powered transport apparatus is provided that is configured to provide powered transport of a patient support. The patient support has a head end, a foot end longitudinally spaced apart from the head end, a first longitudinal side, and a second longitudinal side. The head and foot ends and the first and second longitudinal sides cooperate to define a footprint of the patient support. The powered transport apparatus includes a frame adapted to enter the footprint of the patient support between the first and second ends of the patient support and a powered wheel rotatably supported by the frame to provide powered transport to the patient support.

According to another aspect of the present invention, an apparatus is provided that is configured to provide powered transport of a patient. The apparatus includes a patient support and a powered transport apparatus configured to assist a caregiver in moving the patient support from one location to another. The patient support includes a frame and a patient rest surface. The patient support defines a footprint having a head end, a foot end, and first and second spaced-apart longitudinal sides extending between the head and foot ends. The powered transport apparatus is removably connected to the patient support at a connection location that is accessible by the powered transport apparatus through one of the first and second longitudinal sides of the footprint.

According to another aspect of the invention, a method of transporting a patient support is provided. The patient support defines a footprint having a head end, a foot end, and first and second spaced-apart longitudinal sides extending between the head and foot ends. The method includes the steps of providing a powered transport apparatus; penetrating at least one of the first and second longitudinal sides of the footprint with at least a portion of the powered transport apparatus; removably connecting the powered transport apparatus to the patient support; transporting the patient support with the powered transport apparatus; and disconnecting the powered transport apparatus from the patient support.

Additional features of the disclosure will become apparent to those skilled in the art upon consideration of the following detailed description when taken in conjunction with the accompanying drawings.

BRIEF DESCRIPTION OF THE DRAWINGS

A detailed description particularly refers to the accompanying figures in which.

DETAILED DESCRIPTION OF THE DRAWINGS

According to the present disclosure, a patient support 10, such as a hospital bed, gurney, or the like is provided on which a patient rests during recovery from an illness or medical procedure. Often, the combined weight of patient support 10, the patient positioned on patient support 10, and any medical equipment coupled to patient support 10 make it difficult for a caregiver to push or move patient support 10 from one location in a care facility to another. Thus, according to the present disclosure, a powered transport apparatus 12 is provided to assist a caregiver in moving patient support 10 from one location in a care facility to another.

Figure 1:
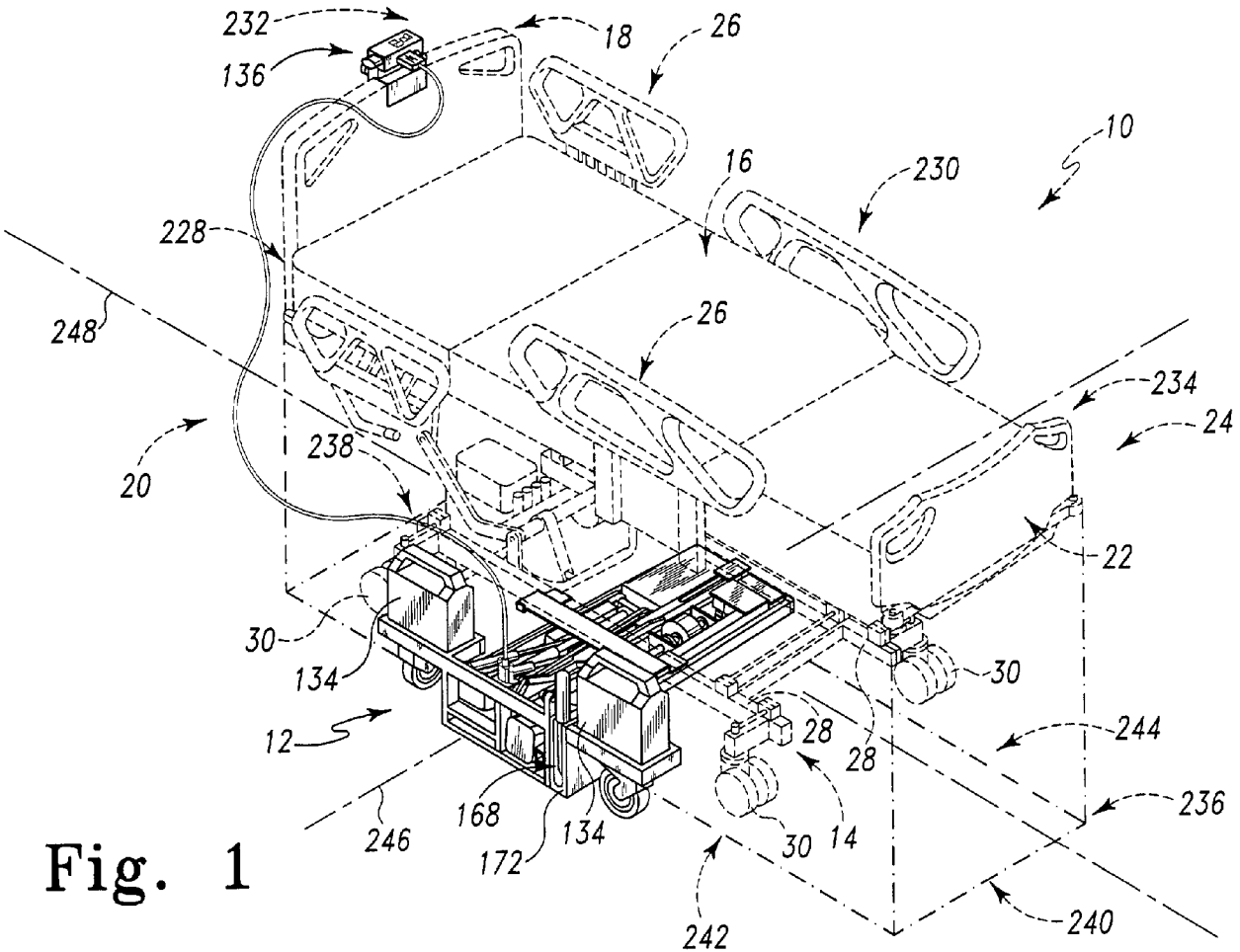
FIG. 1 is a perspective view of a powered transport apparatus (shown in solid) positioned under a patient support (shown in phantom)

As shown in FIG. 1, patient support 10 includes a frame 14, a mattress 16 positioned on frame 14, a headboard 18 defining a head end 20 of patient support 10, a footboard 22 defining a foot end 24 of patient support 10, and a plurality of siderails 26 connected to frame 14. Frame 14 includes a pair of longitudinally extending frame members 28 supported on the floor by a plurality of casters 30. According to alternative embodiments of the present disclosure, other configurations of patient supports known to those of ordinary skill in the art are provided.

Transport apparatus 12 is configured to removably connect to patient support 10. When connected to patient support 10, transport apparatus 12 provides power to move patient support 10 in either forward or reverse. According to alternative embodiments of the present disclosure, the transport apparatus is configured to move the patient support side-to-side. When disconnected from patient support 10, transport apparatus 12 may be moved to another patient support (not shown) and connected thereto or moved to a storage location.

Figure 2:
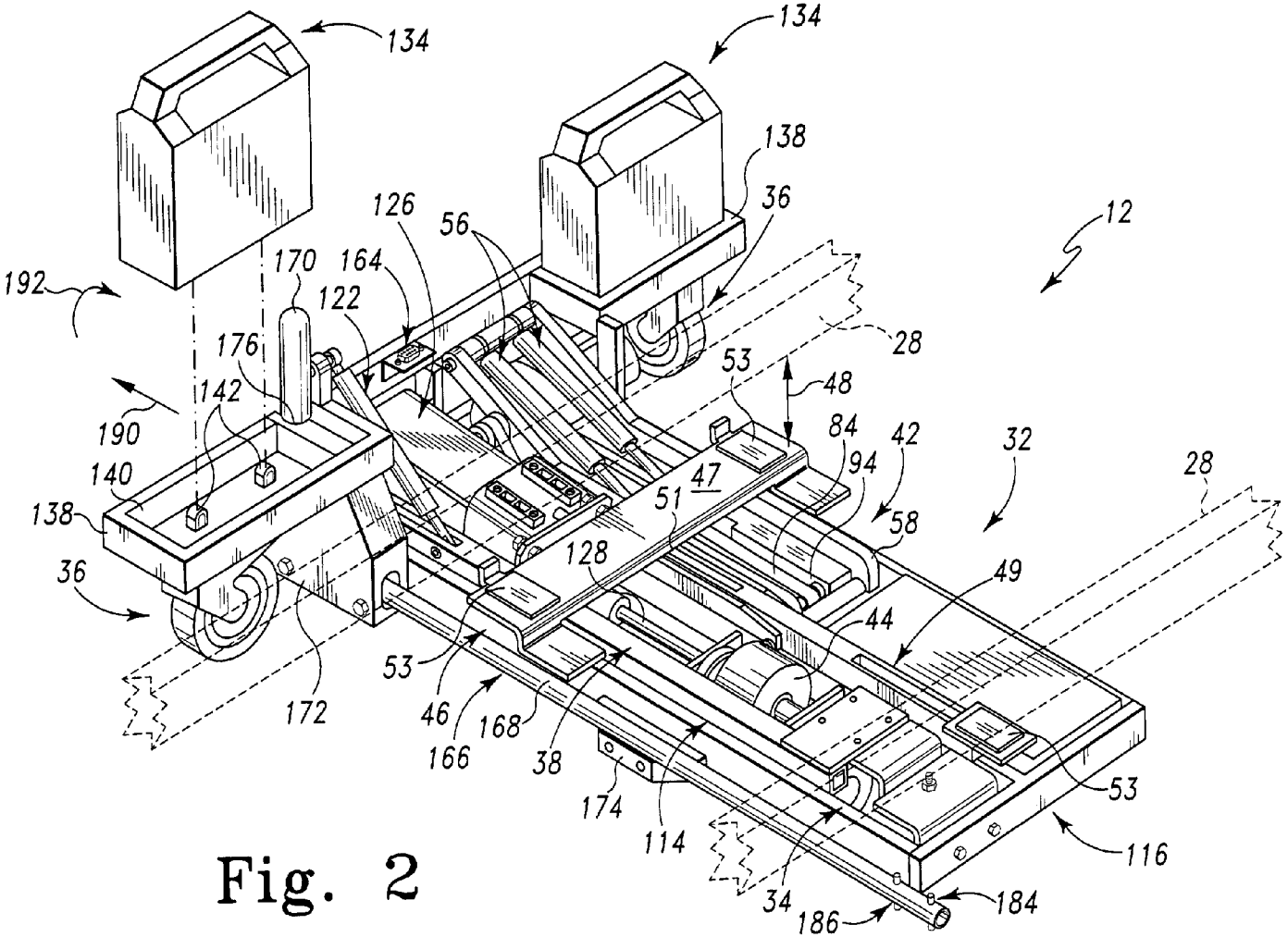
FIG. 2 is a perspective view of the transport apparatus showing the transport apparatus positioned under a pair of longitudinally extending frame member (shown in phantom) of the patient support and spaced apart therefrom.

As shown in FIG. 2, transport apparatus 12 includes a frame 32 supported on the floor by a plurality of casters 34, 36 and a powered drive assembly 38 that contacts the floor and propels transport apparatus 12. Transport apparatus 12 further includes a connection assembly 42 that lowers and raises a powered wheel 44 of powered drive assembly 38 into contact with the floor and raises and lowers a T-shaped connection member 46 into contact with frame members 28.

Figure 6:
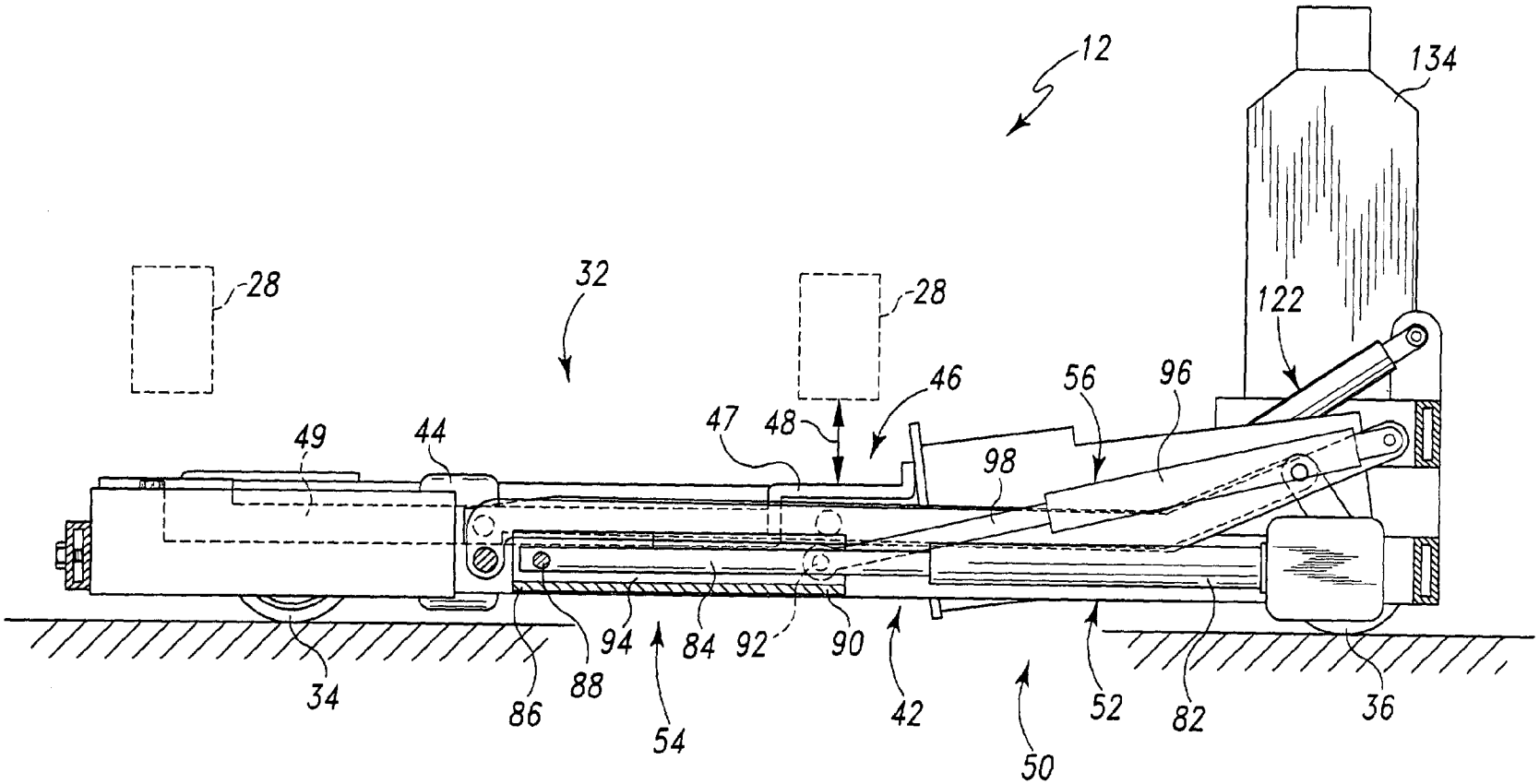
FIG. 6 is cross-sectional view taken along line 6—6 of FIG. 4 showing the transport apparatus including a pair of caster wheels supporting the remainder of the transport apparatus on the floor and a centrally located shuttle member positioned in a left-most position.

Before transport apparatus 12 is connected to patient support 10, connection member 46 is spaced apart from frame members 28 by a distance 48 as shown in FIGS. 2 and 6. After connection member 46 is raised by connection assembly 42, it contacts frame members 28, as shown in FIGS. 3 and 7–9, to form the connection between transport apparatus 12 and patient support 10.

Connection member 46 preferably includes a first member 47 and a second member 49 that couples to a midpoint 51 of first member 47 to define the T-shape of connection member 46. Connection member 46 further includes three pads 53 that cooperate with frame members 28 to define first, second, and third connection locations 55, 57, 59. First connection location 55 is laterally spaced apart from second and third connection locations 57, 59 by a distance equal to a distance between frame members 28 of patient support 10. Furthermore, first, second, and third connection locations 55, 57, 59 are each longitudinally spaced apart from each other.

According to alternative embodiments of the present disclosure, other configuration of connection locations are provided. For example, according to one alterative embodiment, four connection locations are provided that define a square arrangement. According to other alternative embodiments of the present disclosure, other configurations of connection members, if necessary, are provided to connect to other patient supports. For example, according to one alternative embodiment of the present disclosure, a connection member is provided that connects to a single frame member.

According to the preferred embodiment of the present disclosure, the contact pressure between frame members 28 and connection member 46 connects transport apparatus 12 to patient support 10. According to alternative embodiments of the present disclosure, other connection arrangements or devices are provided. For example, according to one alternative embodiment, a latch is provided to couple or otherwise connect the transport apparatus to the patient support. According to other alternative embodiments, locks, hooks, pins, fasteners, or other connection devices are provided to removably couple or otherwise connect the transport apparatus to the patient support.

To remove the connection, connection member 46 is lowered by connection assembly 42 so that it is spaced apart from frame members 28. Then transport apparatus 12 can be rolled on casters 34, 36 to another patient support or to storage.

Powered wheel 44 is moved to a lowered position by connection assembly 42 to facilitate moving transport apparatus 12 about a care facility on casters 34, 36. When connection assembly 42 connects T-shaped member 46 to frame members 28, it also lowers powered wheel 44 into contact with the floor as shown, for example, in FIGS. 9 and 11. As connection assembly 42 lowers connection member 46 away from frame members 28, it also raises powered wheel 44 from the floor as shown in FIG. 6.

Figure 9:
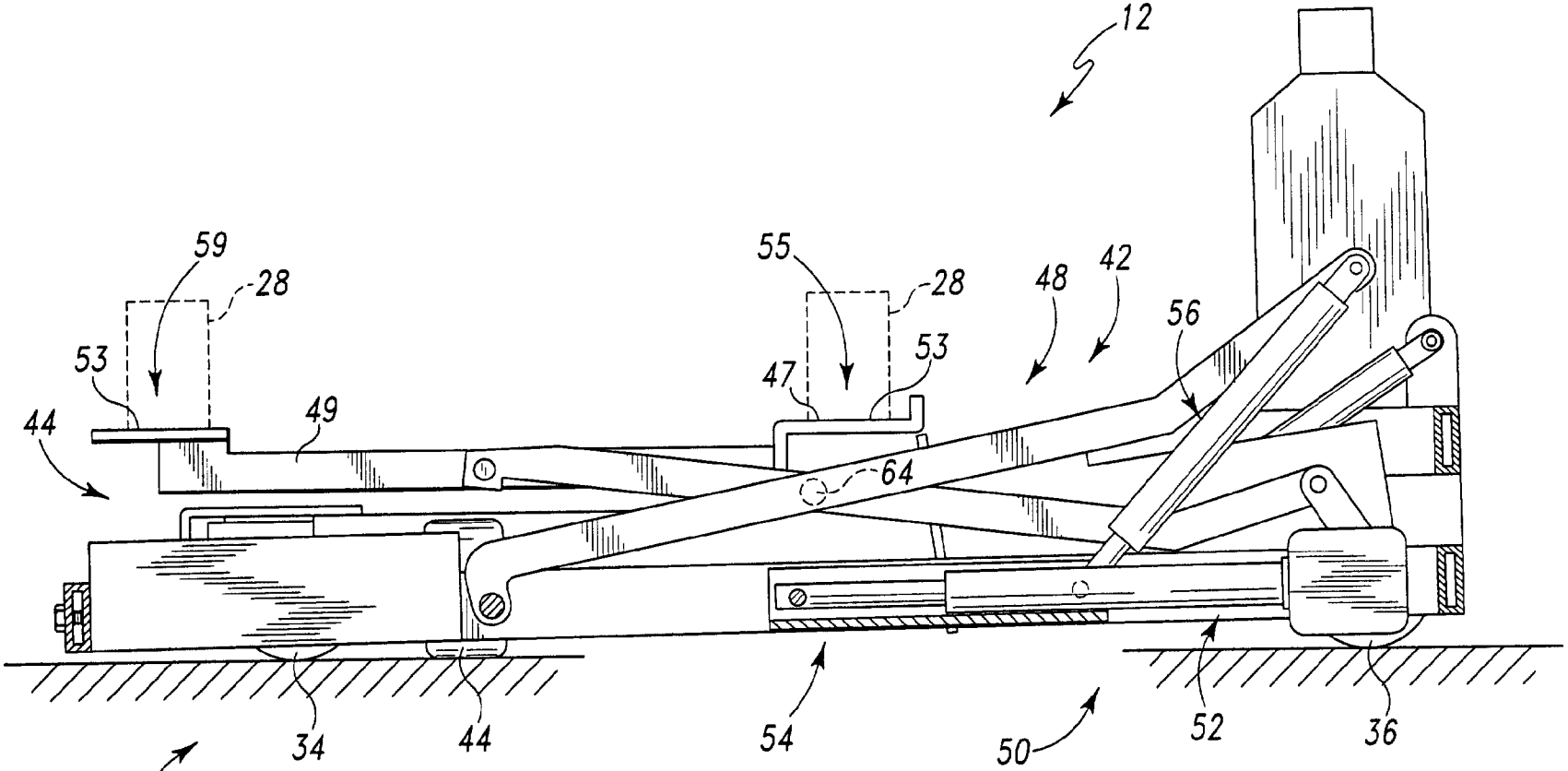
FIG. 9 is a view similar to FIG. 6 showing the shuttle member in a right-most position partially compressing the gas spring.

As shown in FIG. 9, connection assembly 42 includes a scissor mechanism 48 that moves between extended and retracted positions to raise and lower member 46. Connection assembly 42 further includes a scissor mover 50 including an actuator 52, shuttle 54, and a pair of gas springs 56 that move scissor mechanism 48 between the retracted and extended positions.

Scissor mechanism 48 includes a pair of first links 58 and a second link 60 that is pivotably coupled to first links 58 by a pin 64. First links 58 include first ends 66 that are pivotably coupled together and pivotably coupled to frame 32 by a pin 68 and second ends 70 that are coupled together and pivotably coupled to gas springs 56 by a pin 72. Second link 60 includes a first end 74 that is pivotably coupled to a yoke-like portion of frame 32 by a pin 76 and a yoke-like second end 78. Connection member 46 is pivotably supported by yoke-like second end 78 by a pin 80 to connect connection member 46 to frame 32.

According to alternative embodiments of the present disclosure other configurations of devices are provided for raising and lowering the connection member. For example, according to one alterative embodiment, a telescoping device is provided to raise and lower the connection member. According to other alternative embodiments of the present disclosure, other such devices are provided, such as other link configurations, actuators, or other devices for moving objections known to those of ordinary skill in the art.

Actuator 52 includes a base 82 that is rigidly coupled to frame 32 and a shaft 84 that extends and retracts from base 82 as shown in FIGS. 6–9. Shuttle 54 is slidably coupled to frame 32 and is moved between a left-most position, as shown in FIG. 6, to a right most position, as shown in FIG. 9, by the extension and retraction of shaft 84 of actuator 52. Shuttle 54 includes a first end 86 coupled to shaft 84 by a pin 88, a second end 90 pivotably coupled to gas spring 56 by a pin 92, and a channel 94 extending between the first and second ends 86, 90 that is sized to receive shaft 84 and a portion of base 82.

Each gas spring 56 includes a cylinder 96 that is pivotably coupled to first links 62 by pin 72 and a piston 98 that is received by cylinder 96 and pivotably coupled to shuttle 54 by pin 92. During movement of shuttle 54, gas springs 56 are compressed and uncompressed. Thus, springs 56 are compliant members that have adjustable lengths. As shown in FIG. 6, gas springs 56 have a first length when piston 98 is fully extended from cylinder and a second length when piston 98 is partially retracted in cylinder 96.

Figure 7:
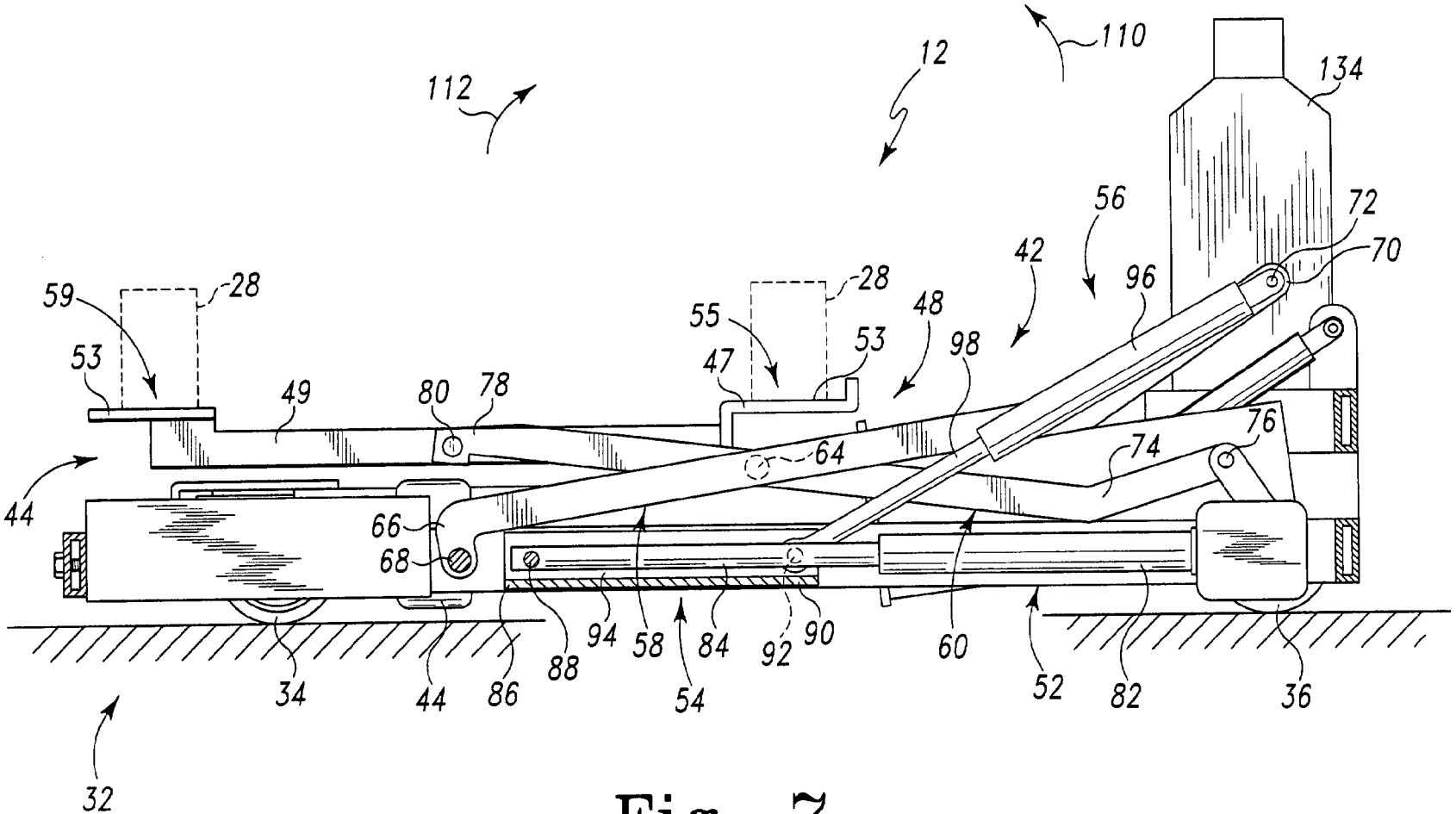
FIG. 7 is a view similar to FIG. 6 showing the shuttle member shifted slightly to the right so that a gas spring coupled to a right end thereof pushes on a scissor mechanism to raise a connection member into contact with the frame members of the patient support.

Movement of shuttle 54 by actuator 52 from the left-most position creates a force on gas springs 56. This force raises second end 70 of first link 58 and causes first links 58 to rotate in a counter-clockwise direction 110 as shown in FIG. 7. This movement of first link 58 causes second link 60 to rotate in a clockwise direction 112 causing second end 78 and connection member 46 to raise until connection member 46 contacts frame members 28. This contact connects transport apparatus 12 to patient support 10.

Figure 8:
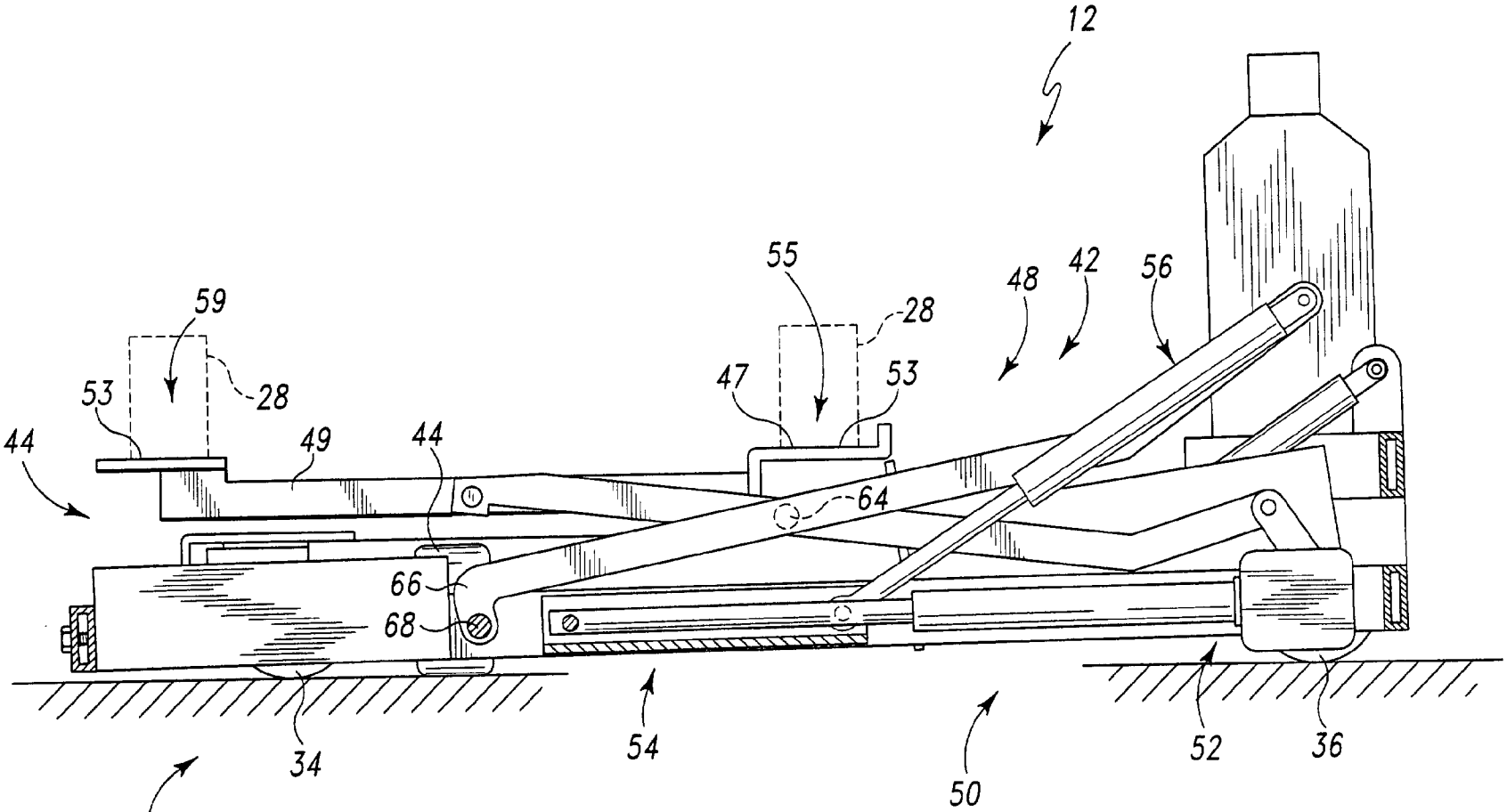
FIG. 8 is a view similar to FIG. 6 showing the shuttle member shifted further to the right so that the gas spring continues to push on the scissor mechanism to lower a powered wheel into contact with the floor.

Further movement of shuttle 54 to the right by actuator 52 causes powered wheel 44 to lower as shown in FIG. 8. Because connection member 46 is in contact with frame members 28, it resists further upward movement and scissor mechanism 48 resists any further upward extension. Thus, downward force is transferred from first end 66 of first link 58 to frame 32.

Figure 10:
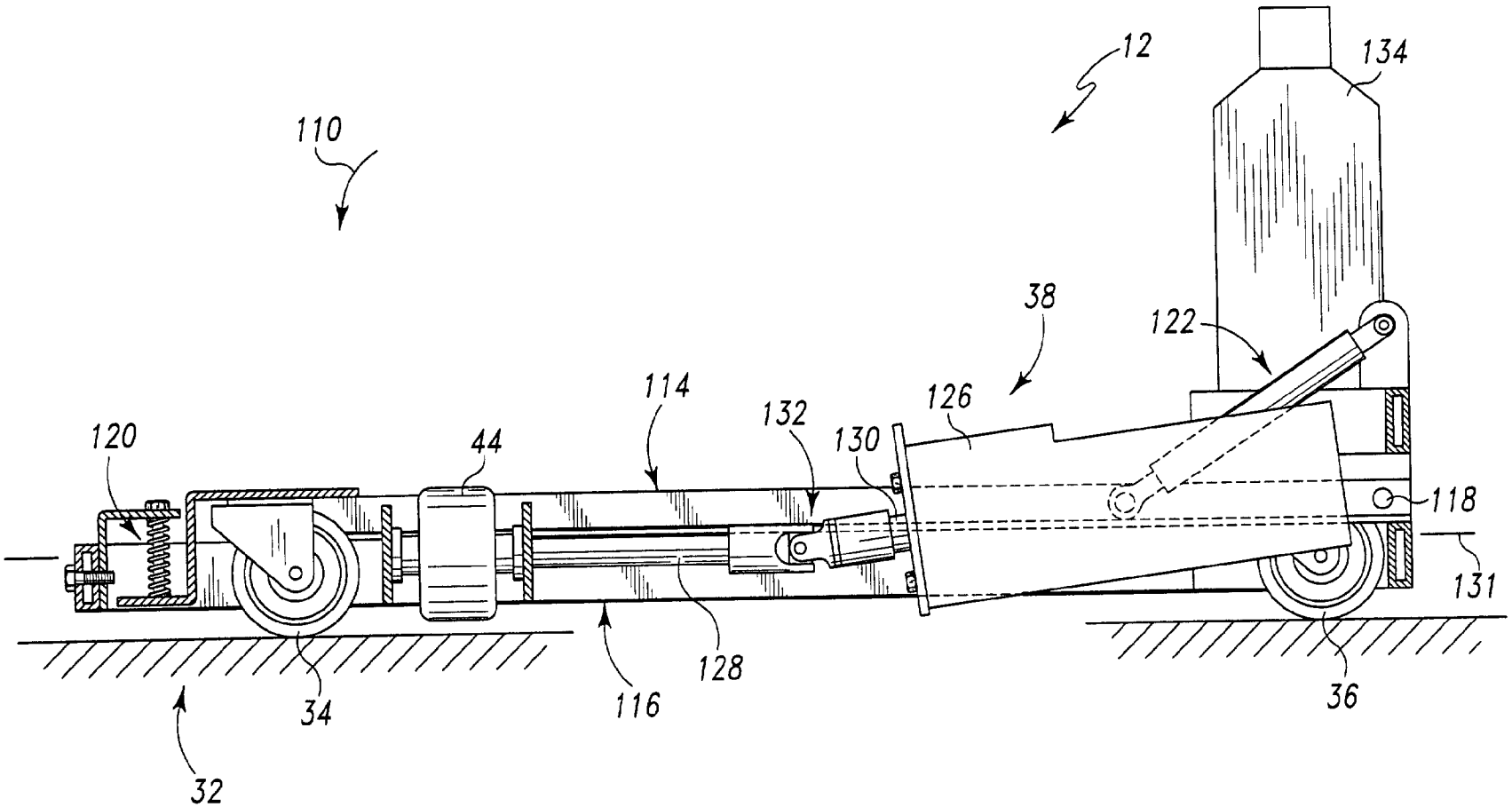
FIG. 10 is a cross-sectional view taken along line 10—10 of FIG. 4 showing the caster wheels supporting the remainder of the transport apparatus on the floor with the powered wheel spaced apart from the floor.

Frame 32 is configured to facilitate raising and lowering of powered wheel 44 by connection assembly 42. As shown in FIG. 10, frame 32 includes a stationary frame 114 supported by caster 34 and a non-stationary frame 116 supported by casters 36 and pivotably coupled to stationary frame 114 by a pin 118. Powered drive assembly 38 with powered wheel 44 is supported by non-stationary frame 116. First end 66 of first link 58 is pivotably coupled to non-stationary frame 116 by pin 68. Thus, the downward force on first end 66 of first link 58 that is created by furthering movement of shuttle 54 to the right is transferred to non-stationary frame 116.

Figure 11:
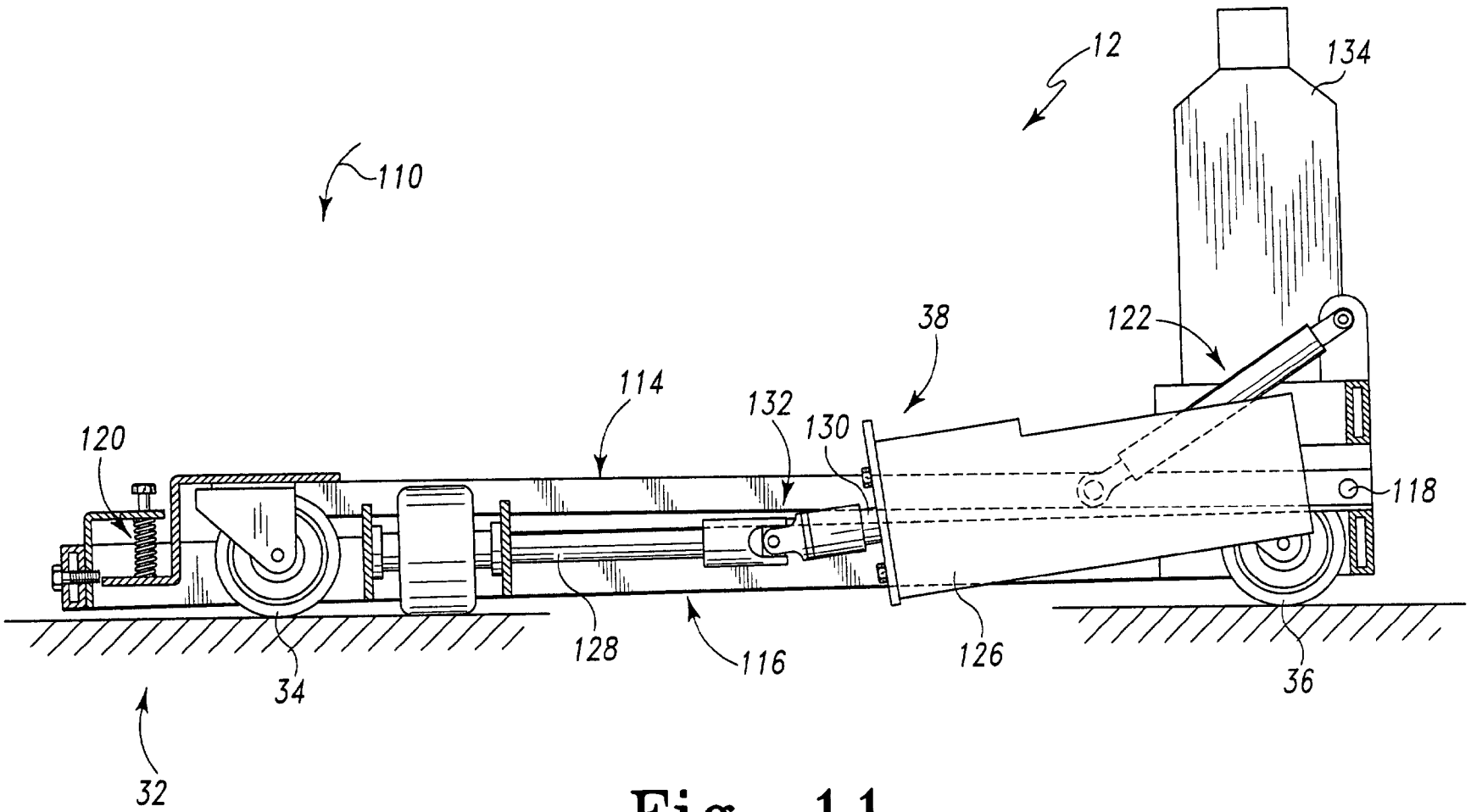
FIG. 11 is a view similar to FIG. 10 showing the powered wheel lowered into contact with the floor.

This downward force causes non-stationary frame 116 to rotate in counterclockwise direction 110 relative to stationary frame 114 as shown in FIG. 11. Because powered drive assembly 38 is supported by non-stationary frame 116, the rotation lowers powered wheel 44 into contact with the floor. This contact provides traction between powered wheel 44 and the floor to permit propulsion of patient support 10 by transport apparatus 12.

Connection assembly 42 is also configured to provide for additional traction between powered wheel 44 and the floor and is also configured to maintain traction therebetween when powered wheel 44 rides over a bump or depression in the floor. As shown in FIG. 9, actuator 52 continues to move shuttle 54 to the right from the position shown in FIG. 8 and compresses gas springs 56.

Because powered wheel 44 is in contact with the floor, it and non-stationary frame 116 cannot rotate any further. Thus, scissor mechanism 48 cannot extend any further downward toward the floor. As previously mentioned, contact with frame members 28 prevents any further upward extension of scissor mechanism 48. Thus, scissor mechanism 48 cannot extend any further to compensate for the additional movement of shuttle 54. To compensate for this movement, gas springs 56 yield or compress to about half their total compression as shown in FIG. 9.

This resulting compression of springs 56 creates additional friction or "grip" between connection member 46 and frame member 28 and between powered wheel 44 and the floor. The force required to compress gas springs 56 is transmitted through scissor mechanism 48 to connection member 46. This force causes connection member 46 to push up on frame members 28 and increases the frictional or grip forces therebetween. Scissor mechanism 48 also transmits this force to non-stationary frame and powered wheel 44 supported thereby. This force increases the normal forces and grip between powered wheel 44 and the floor making it less likely for powered wheel 44 to slip on the floor.

Gas springs 56 also permit powered wheel 44 to remain in partial contact with the floor when it rides over a bump or depression. Because gas springs 56 are compressed by movement of shuttle 54, it has stored energy to move powered wheel 44 into a depression and also permits upward movement of powered wheel 44 over a bump.

If powered wheel 44 rolls over a depression, it must lower into the depression to maintain contact with the floor. Without this contact, powered wheel 44 will not be able to push or pull patient support 10. Because gas springs 56 are compressed, it is constantly applying force to scissor mechanism 48. As mentioned above, the floor and frame members 48 normally prevent this force from moving scissor mechanism 48, non-stationary frame 116, and wheel 44. However, when wheel 44 rides over a depression, the floor no longer resists downward movement of wheel 44 so that the force applied to scissor mechanism 48 by gas springs 56 pushes non-stationary frame 116 down so that wheel 44 remains in contact with the floor. When wheel 44 rides out of the depression, the floor forces wheel 44 up, causing non-stationary frame 116 to rotate up and scissor mechanism 48 to retract slightly, and compressing springs 56. Thus, the energy storage or bias provided by compressed spring 56 keeps wheel 44 in contact with the floor.

When wheel 44 rides over a bump, such as a threshold in a doorway, spring 56 is further compressed. Similar to when wheel 44 rides out of a depression, the bump forces wheel 44 up, causes non-stationary frame 116 to rotate up and scissor mechanism 48 to retract slightly, and compresses spring 56. After wheel 44 is over the bump, gas spring 56 causes scissor mechanism 48 to extend and non-stationary frame 116 to rotate down to the floor. Thus, the compliance of gas springs 56 permits wheel 44 to ride over a bump without applying undue stress on the other components of transport apparatus 12 and the energy storage or bias pushes wheel 44 back down into contact with the floor.

Return springs 120, 122 are provided to assist in raising wheel 44 away from the floor. As shown in FIG. 10, coil spring 120 is positioned between stationary and non-stationary frames 114, 116. When non-stationary frame 116 is lowered, spring 120 is compressed. Similarly, gas spring 122 is positioned between stationary and non-stationary frames 114, 116. When non-stationary frame 116 is lowered spring 122 is also compressed. The compression in these springs 120, 122 assists in returning wheel 44 back to the raised position.

To remove the biasing load provided by gas springs 56, shuttle 54 is moved back to the left by actuator 52 to the position shown in FIG. 8. Moving shuttle 54 to this position relieves the force that compresses gas springs 56 so that gas springs 56 are fully extended. Further movement to the left permits compressed springs 120, 122 to move non-stationary frame 116 back to the raised position relative to stationary frame 114 to raise wheel 44. This movement also causes scissor mechanism 48 to retract slightly as shown in FIG. 7.

To disconnect transport apparatus 12 from patient support, shuttle member 54 is moved further to the left to the position shown in FIG. 6. Because gas springs 56 are fully extended, further movement of shuttle 54 creates tension in gas springs 56 and pulls first links 58 in clockwise direction 112. This movement of first links 58 causes second link 60 to rotate in counter-clockwise direction 112 to lower connection member 46.

In addition to providing the drive contact with the floor through powered wheel 44, drive assembly 38 also provides the power to necessary to rotate wheel 44. As shown in FIG. 10, drive assembly 38 includes a drive motor 126 and an axle 128 coupled to non-stationary frame 116 that supports powered wheel 44. A shaft 130 of drive motor 126 is coupled to axle 128 by a U-joint 132 to rotate axle 128 and powered wheel 44 about an axis of rotation 131 that is substantially perpendicular to frame members 28.

Drive motor 126 is powered by a pair of batteries 134 supported by non-stationary frame 116 and is controlled by a controller 136. Batteries 134 are supported by a pair of platforms 138 having sockets 140 formed therein and terminals 142 that electrically couple to batteries 134. When batteries 134 are charged, they are plugged into sockets 140 and terminals 142 provide an electrical connection between batteries 134 and the wiring (not shown) of transport apparatus 12. When the charge of batteries 134 is low, the caregiver removes batteries 134 from sockets 140 to a charging station (not shown). According to an alternative embodiment of the present disclosure, a battery charger is provided that charges the batteries while positioned on the transport apparatus.

Figure 5:
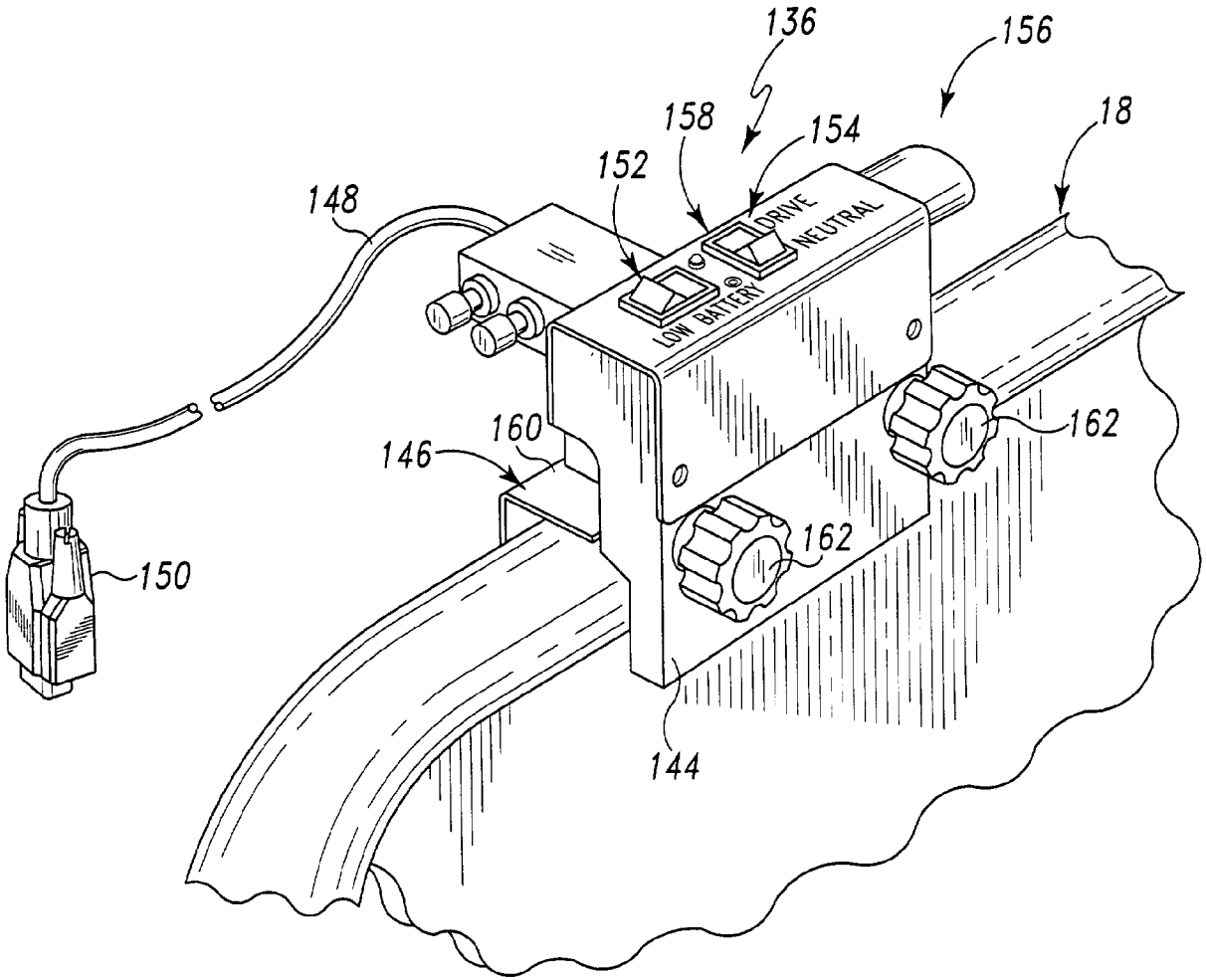
FIG. 5 is perspective view of a controller of the transport apparatus showing the controller hooked over a headboard of the patient support.

Controller 136 operates to control lowering and raising of powered wheel 44 and raising and lower of connection member 46. As shown in FIG. 5, controller 136 includes a housing 144, a clamp 146 that connects housing 144 to headboard 18, a cord 148 extending from housing 144 with a plug connector 150, an on/off toggle button 152, a drive/neutral toggle button 154, a throttle 156, and a battery charge indicator 158.

Clamp 146 is configured to connect housing 144 to headboard 18 and includes a clamp member 160 and pair of knobs 162 threaded into housing 144 and claim member 160. Knobs 162 are turned to increase and decrease the distance between clamp member 160 and housing 144. When enough distance is provided therebetween to slip controller 136 over headboard 18, knobs 162 are turned to squeeze headboard 18 between clamp member 160 and housing 144. To remove controller 136 from headboard 18, knobs 162 are turned in the opposite direction.

Cord 148 communicates electronic signals between controller 136 and the other electrical components of transport apparatus 10. Connector 150 is provided to removably connect cord 148 to a plug connector 164 on frame 32 as shown in FIG. 2. Cord 148 communicates signals or control commands from on/off toggle button 152, drive/neutral toggle button 154, and throttle 156 and receives a signal for battery indicator 158.

On/off toggle button 152 enables the raising and lowering of connection member 46. When toggle button 152 is moved to the on position, actuator 52 moves shuttle 54 to the position shown in FIG. 9 to create contact between transport apparatus 12 and patient support 10 and to lower wheel 44 into contact with the floor. When toggle button 152 is moved back to the off position, actuator 52 moves shuttle 54 back to the position shown in FIG. 6 to raise wheel 44 and lower connection member 46 to remove the connection between transport apparatus 12 and patient support 10.

Drive/neutral toggle button 154 controls the application of power to drive motor 126. When toggle button 154 is in the drive position, power is provided to drive motor 126 to enable rotation of wheel 44. When toggle button 154 is in the neutral position, no power is provided to drive motor 126 and wheel 44 is free to rotate.

Throttle 156 is provided to control the direction and speed of rotation provided to wheel 44 by drive motor 126. When throttle 156 is in a neutral position, no voltage is provided to drive motor 126 so that wheel 44 does not rotate. When throttle 156 is rotated forward, a positive voltage is provided to drive motor 126 causing wheel 44 to rotate and push patient support 10 in a forward direction. The applied voltage is a function of the amount of rotation of throttle 156. The more throttle 156 is rotated, the more voltage is applied to drive motor 126 causing wheel 44 to increase in speed. When throttle 156 is rotated in reverse, a negative voltage is provided to drive motor 126 causing wheel 44 to rotate in an opposite direction and push patient support 10 in a reverse direction. The more throttle 156 is rotated in the reverse direction, the faster wheel 44 pushes the bed in reverse. When throttle 156 is released, it returns to the neutral position and no voltage is applied to drive motor 126 so that wheel 44 does not apply any motive force.

After drive motor 126 of transport apparatus 12 is used to transport several patient supports 10, batteries 134 begin to lose enough charge to affect the operation of motor 126. When batteries 134 begin to approach this level of charge, charge indicator 158 lights up indicating that batteries 134 need to be recharged or replaced by the spare batteries.

As previously mentioned, when transport apparatus 12 is not being used to move a patient support 10, it is placed in storage. To move transport apparatus 12 from storage to a patient support 10 or from patient support to patient support, a handle 166 is provided as shown in FIG. 3.

Figure 3:
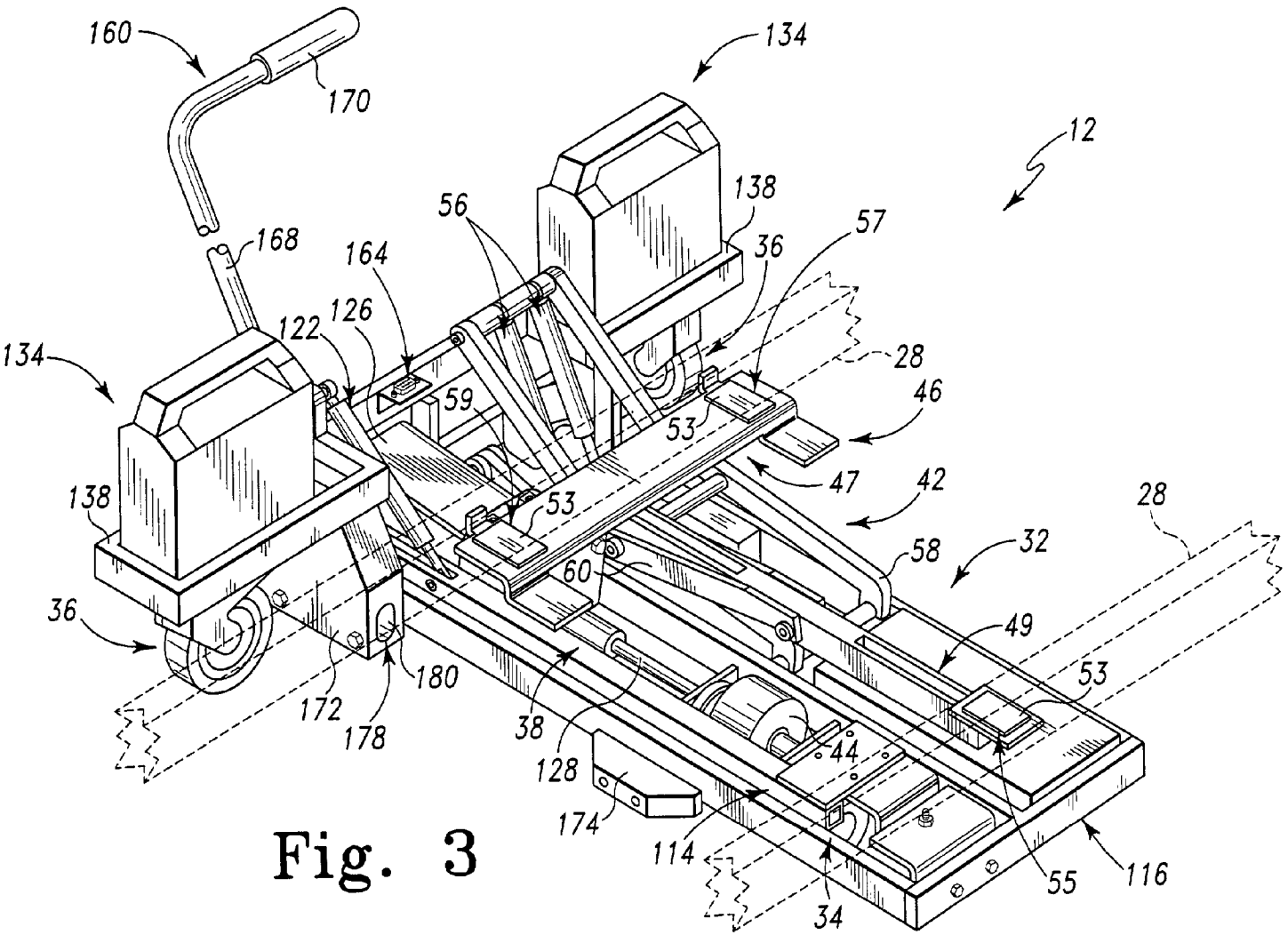
FIG. 3 is view similar to FIG. 2 showing the transport apparatus in contact with the frame members.

Handle 166 is configured to have a use position, as shown in FIG. 3, and a storage position as shown in FIG. 2. When in the use position, a support portion 168 of handle 166 extends upwardly so that a handle portion 170 is positioned a convenient height for a caregiver. When in the storage position, handle portion 170 is tucked into a handle support block 172 coupled to frame 32 and support portion 168 rests on another support block 174 coupled to frame 32.

Figure 16:
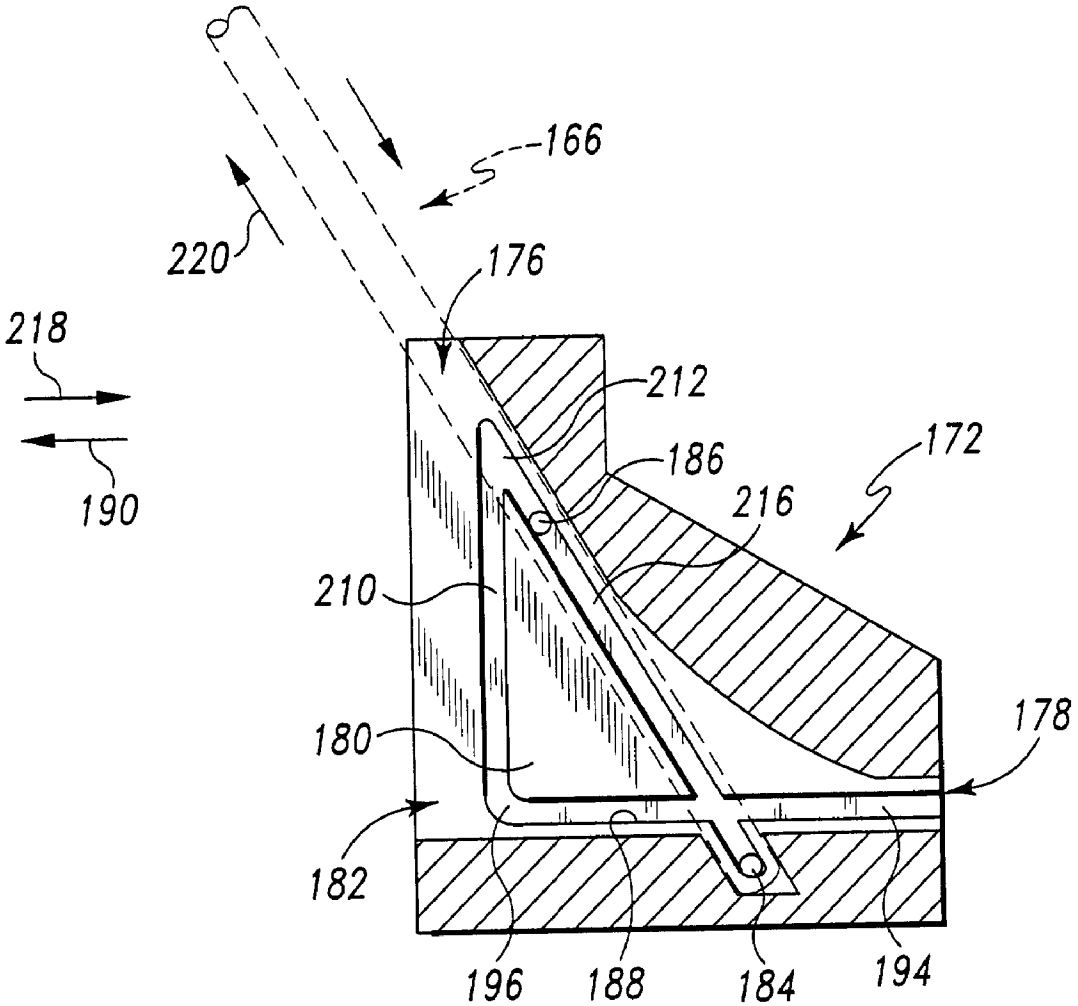
FIG. 16 is a view similar to FIG. 14 showing the handle moved down and to the right so that the pins are positioned in a diagonal straight portion of the channel.

Support block 172 includes a first aperture 176 through which support portion 168 of handle 166 extends when handle 166 is in the use position, as shown in FIG. 16, and handle portion 170 is positioned when in the storage position as shown in FIG. 2. Support block 172 also includes a second aperture 178 in which support portion 168 of handle 166 is positioned when in the storage position. Support block 172 further includes an inner surface 180 that defines a keyed passage 182 extending between first and second apertures 178.

Handle 166 further includes first and second keys or pins 184, 186 that hold support portion 168 of handle 166 in the use position. As shown in FIG. 2, first pin 184 is positioned adjacent an end of support portion 168 and second pin 186 is positioned between first pin 184 and handle portion 170.

Inner surface 180 further defines a pair of channels 188 sized to receive first and second pins 184, 186. Channels 188 constrain the movement of pins 184, 186 so that pins 184, 186 hold support portion 168 in the use position. Channels 188 are spaced apart enough to permit pins 184, 186 to slide therein, but prevent pins 184, 186 from exiting except through aperture 178.

Figure 13:
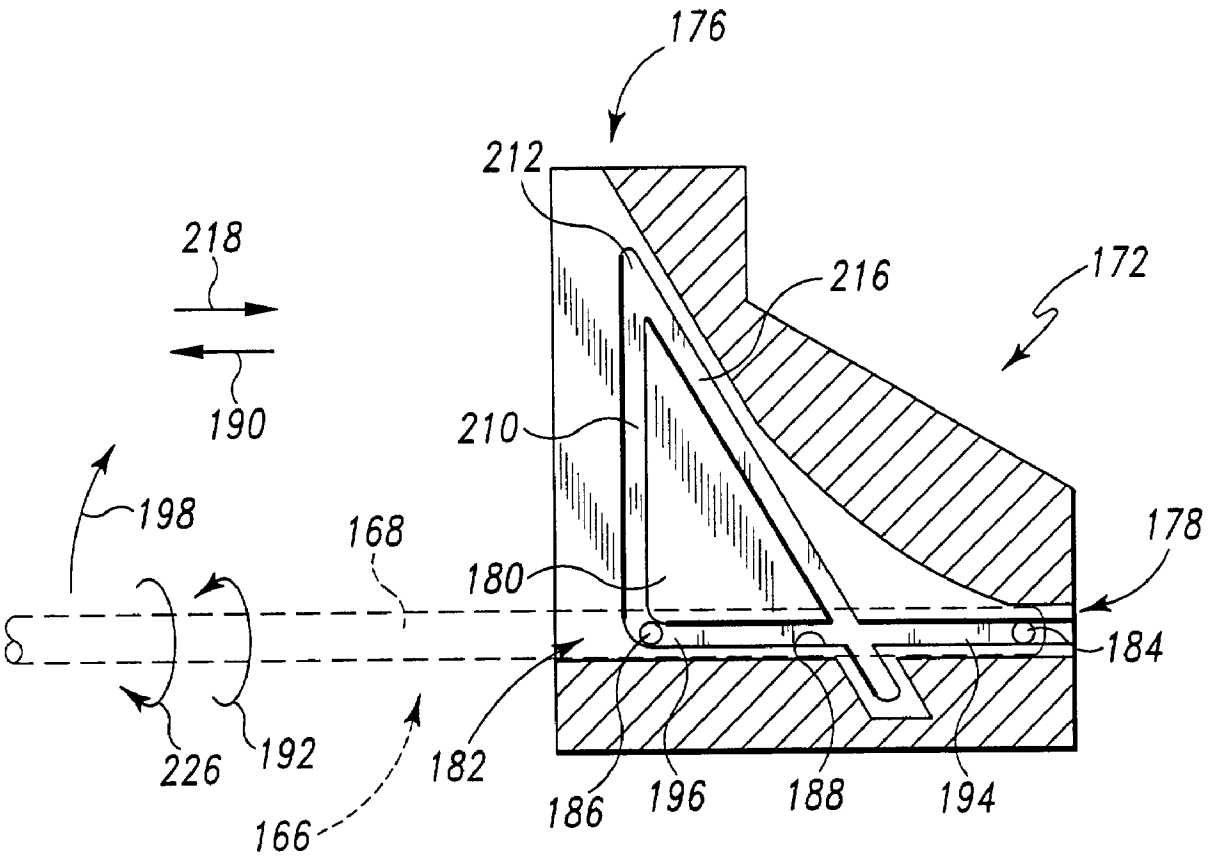
FIG. 13 is a cross-sectional view taken along line 13—13 of FIG. 12 showing a portion of the handle (shown in phantom) in a horizontal position with a pair of pins positioned in a channel defined by the support block.
Figure 12:
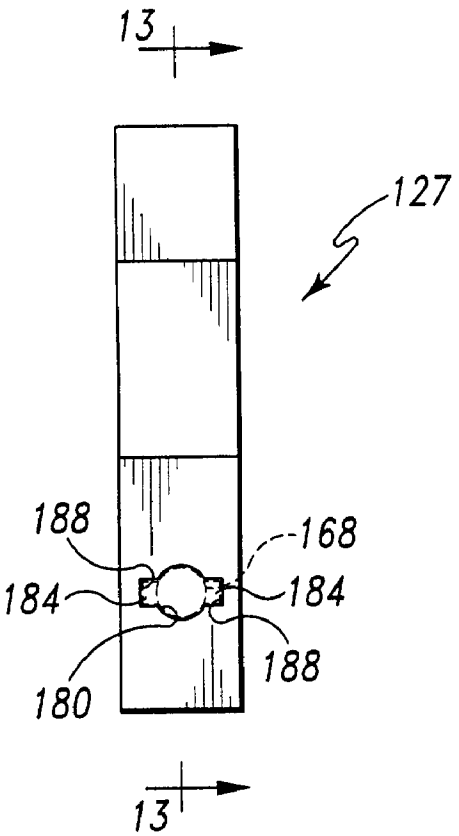
FIG. 12 is an end view of a support block configured to support a handle of the transport apparatus showing the support block including a keyed aperture.
Figure 14:
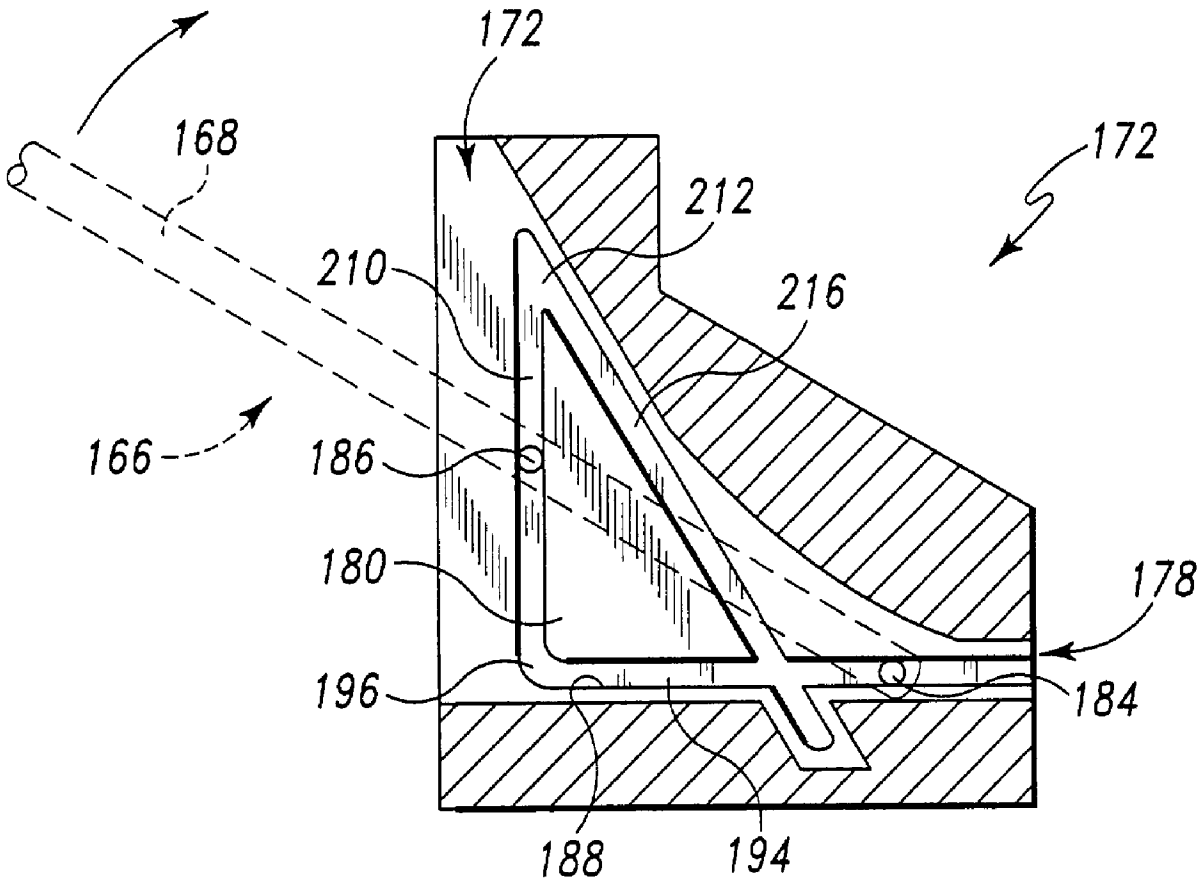
FIG. 14 is a view similar to FIG. 13 showing the handle rotated in a clockwise direction with one of the pins positioned in a left-most straight portion of the channel.
Figure 15:
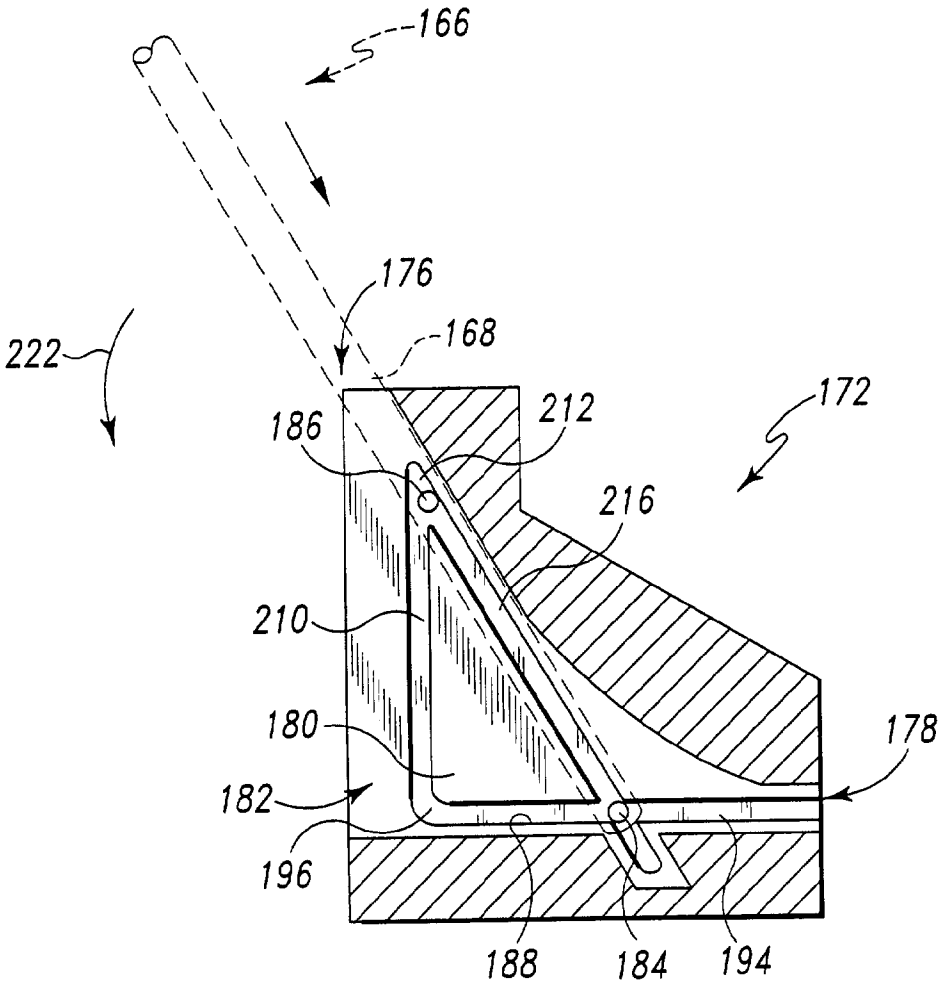
FIG. 15 is a view similar to FIG. 13 showing the handle rotated further in the clockwise direction with one of the pins positioned in an upper-most bend in the channel and the other pin positioned in a junction of two straight portions of the channel.

To move handle 166 from the storage position to the use position, a caregiver backs handle portion 170 out of first aperture 176 in direction 190 and rotates handle 166 approximately 90° in direction 192 so that pins 184, 186 align with channels 188 as shown in FIG. 12 for pins 184. The caregiver continues to pull handle 166 in direction 190 so that pins 184, 186 ride in a first straight portion 194 of channels 188 until second pin 186 reaches a first bend 196 in channels 188 as shown in FIG. 13. The caregiver then rotates handle 166 in direction 198 so that second pin 186 moves in a second straight portion 210 toward a second bend 212 in channels 188 as shown in FIG. 14. After second pin 186 reaches second bend 212, as shown in FIG. 15, handle 166 is pushed down in direction 214 to the use position so that first and second pins 184, 186 move down into third straight portion 216 as shown in FIG. 16. Gravity helps keep handle 166 in this position.

When in the use position, channels 188 prevent pins 184, 186 from moving in directions 190, 218 or side-to-side so that a caregiver can push or pull on handle 166 to move transport apparatus 12 about a care facility. Channel 188 also prevents pins 184, 186 from rotating so that handle portion 170 remains substantially horizontal with the floor.

Handle 166 is typically put back in the storage position after transport apparatus 12 is positioned under patient support 10 or when placed in storage. To place handle 166 in the storage position, the caregiver handle 166 is pulled in direction 220, as shown in FIG. 16, so that second pin 186 is positioned in second bend 212, as shown in FIG. 15. The caregiver then rotates handle 166 in direction 222 so that second pin 186 enters second straight portion 210 and first pin 182 enters first straight portion 194, as shown in FIG. 14, until second pin 186 reaches first bend 196, as shown in FIG. 13. Handle 166 is then pushed in direction 218 so that pins 184, 186 leave support block 172. Handle 166 is rotated approximately 90° in direction 226 so that handle portion 170 aligns with first aperture 176. The caregiver continues pushing handle 166 in direction 224 until handle portion 170 is positioned in first aperture 176 and support portion 168 is positioned on second support block 174 as shown in FIG. 2.

Transport apparatus 12 is configured to connect to patient support 10 from either of first or second longitudinal sides 228, 230 of patient support 10. For example, as shown in FIG. 1, a caregiver has inserted transport apparatus 12 under a patient support through first longitudinal side 228.

Patient support 10 includes a head end 232 and a foot end 234 that cooperate with first and second longitudinal sides 228, 230 to define a footprint 236 of patient support 10. Footprint 236 has head and foot ends 238, 240 and first and second longitudinal sides 242, 244 that correspond to head and foot ends 232, 234 and first and second longitudinal sides 228, 230 of patient support 10.

To connect transport apparatus 12 to patient support 10, a caregiver directs transport apparatus 12 along a path that crosses over one of first and second longitudinal sides 242, 244 of footprint 236 between head and foot ends 232, 234 so that transport apparatus 12 is at least partially positioned within footprint 236 of patient support 10. Thus, transport apparatus 12 enters patient support 10 from at least one of first and second longitudinal sides 242, 244 between head and foot ends 232, 234 to connect to patient support 10.

Figure 4:
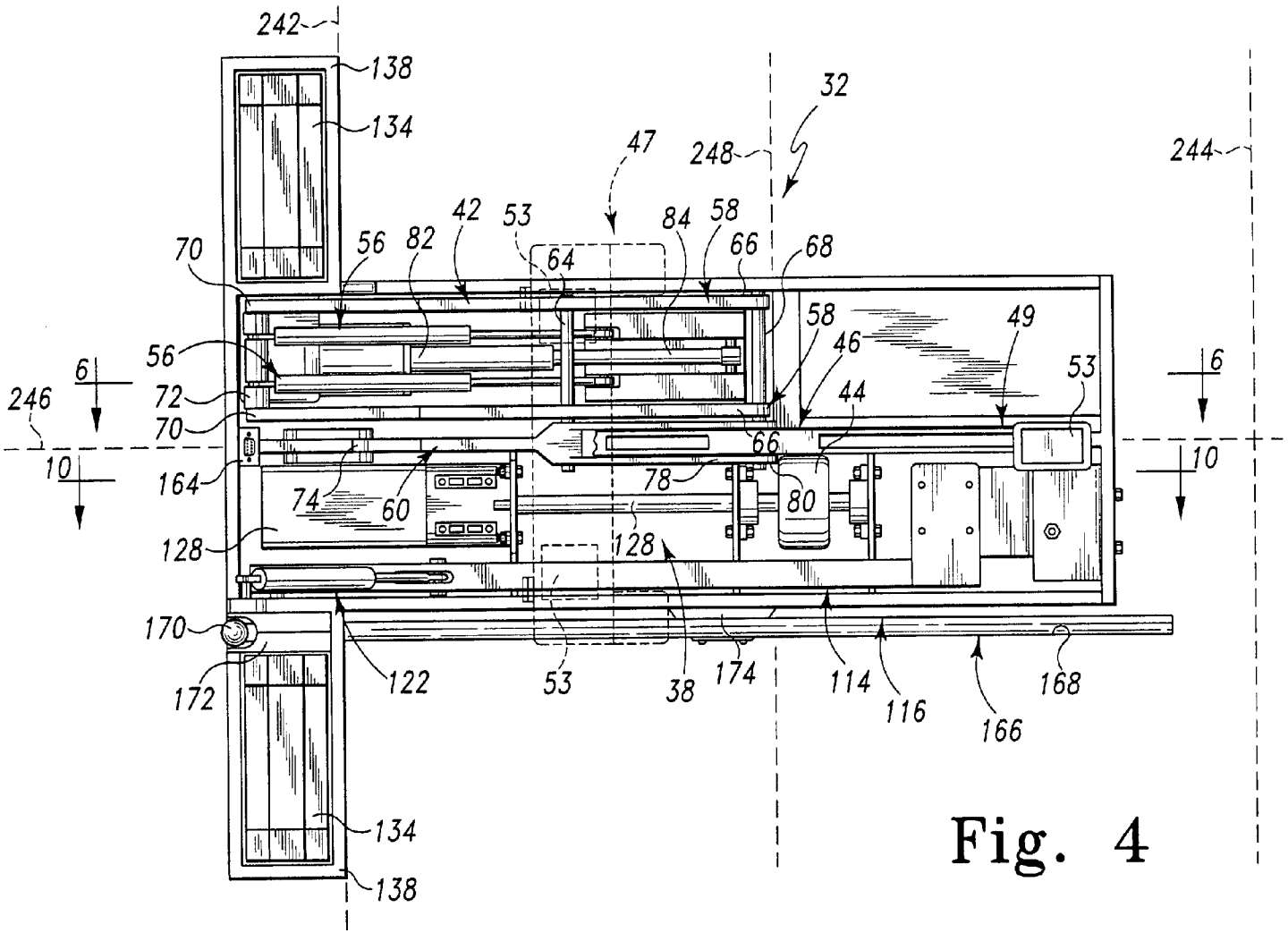
FIG. 4 is a top plan view of the transport apparatus with portions shown in phantom.

As shown in FIG. 4, first, second, and third connection locations 55, 57, 59 are positioned within footprint 236. A caregiver may access each of these connection locations 55, 57, 59 from longitudinal sides 242, 244 of footprint 236. Preferably, the caregiver places transport apparatus 12 under patient support 10 so that first connection location 55 is positioned at a midpoint between first and second ends 238, 240 of footprint 236. The caregiver may also place transport apparatus 12 at other locations within footprint 236.

Preferably, the caregiver directs transport apparatus 12 along a path so that a longitudinal axis 246 of frame 32 of transport apparatus 12 approaches a longitudinal axis 248 of patient support frame 14 at 90°. The caregiver may also direct transport apparatus 12 along other paths with different approach angles. Preferably, the caregiver positions transport apparatus 12 at a midpoint between foot and head ends 232, 234 of patient support 10 so that connection member 46 is positioned under frame members 28.

When properly positioned, the caregiver uses controller 136 to raise connection member 46 as previously described. After being disconnected from patient support 10, transport apparatus 12 is removed from within footprint 236 by backing out transport apparatus 12 along a path the crosses the respective longitudinal side 228, 230 of footprint 236.

By positioning transport apparatus 12 between ends 232, 234 of patient support 10, patient support 10 is free to receive other pieces of medical equipment. For example, some patient supports are configured to receive walkers, exercise bikes, and other devices at a foot end of the patient support (see, for example, U.S. Pat. Nos. 5,513,406 and 5,680,661, the disclosures of which are expressly incorporated by reference herein). According the present disclosure, such devices can remain at the foot end of the patient support while the transport apparatus is positioned under the patient support to move the patient support about a care facility.

Other patient supports are configured to receive equipment at a head end and/or foot end of the patient support (see, for example, U.S. Pat. Nos. 5,497,766; 5,337,845; 5,457,831; and 5,966,760, the disclosures of which are expressly incorporated by reference herein). According to the present disclosure, such devices can remain coupled to the patient support while the transport apparatus is connected thereto. Furthermore, the transport apparatus of the present disclosure may remain connected to patient supports that convert to a chair position (see, for example, U.S. Pat. Nos. 5,398,357; 5,715,548; and 5,802,640, the disclosures of which are expressly incorporated by reference herein) or otherwise make attachment of a transport apparatus to the head or foot ends of the patient support difficult. According to alternative embodiments of the present disclosure, the transport apparatus is configured to connect to the head and/or foot ends of a patient support.

Figure 17:
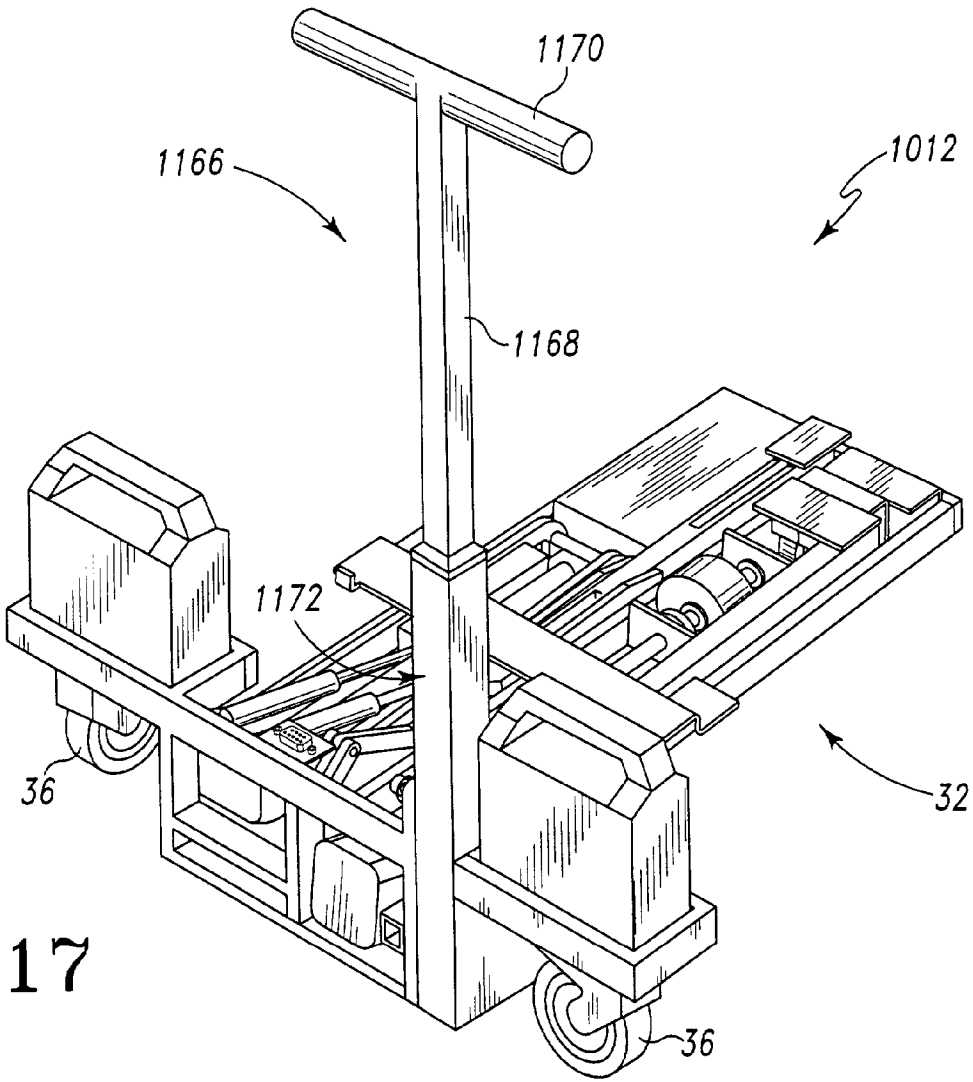
FIG. 17 is a perspective view of an alternative embodiment powered transport apparatus.

An alternative embodiment patient transport apparatus 1012 is shown in FIG. 17. Alternative embodiment patient transport apparatus 1012 is substantially similar to preferred embodiment patient transport apparatus 12, but includes an alternative embodiment handle 1166 and support block 1172. Support block 1172 removably receives handle 1166 so that handle 1166 can be used to move transport apparatus 1012 from one patient support to another and then removed when the transport apparatus 1172 is connected to a patient support or placed in storage.

Handle 1166 includes a support portion 1168 and a handle portion 1170 that cooperate to define a T-shape for handle 1166. Handle portion 1170 is cylinder-shaped to facilitate grasping by a user. Support portion 1168 has a square cross-section.

Support block 1172 removably couples handle 1166 to frame 32. Support block 1172 includes a square passage (not shown) that complements support portion 1168 of handle 1166 to prevent handle 1166 from rotating relative to support block 1172.

Although the present invention has been described in detail with reference to preferred embodiments, variations and modifications exist within the scope and spirit of the present invention as described and defined in the following claims.

What is claimed is:

1. A powered transport apparatus configured to provide powered transport of a patient support, the patient support defining a footprint having head and foot ends and first and second longitudinal sides extending between the head and foot ends, the powered transport apparatus comprising a frame adapted to be positioned under the patient support by entering one of the longitudinal sides of the patient support, a powered wheel rotatably supported by the frame to provide powered transport of the patient support, a scissor mechanism supported by the frame and configured to transfer downward force from the patient support to the powered wheel, the scissor mechanism being movable between a first position transferring downward force from the patient support to the powered wheel and a second position permitting removal of the frame from the patient support, and a connection member, supported by the scissor mechanism, to removably connect the powered transport apparatus to the patient support with contact pressure at a connection location that is accessible by the powered transport apparatus through one of the first and second longitudinal sides of the footprint.

2. The powered transport apparatus of claim 1, wherein the powered wheel is adapted to include an axis of rotation that is substantially perpendicular to the first and seconds longitudinal sides of the patient support when the frame is positioned under the patient support.

3. The powered transport apparatus of claim 1, wherein the frame is adapted to include longitudinal axis that is substantially perpendicular to the longitudinal sides of the patient support when the frame is positioned under the patient support.

4. The powered transport apparatus of claim 1, wherein the frame is adapted to be positioned at a midpoint between the head and foot ends of the patient support when positioned under the patient support.

5. The powered transport apparatus of claim 1, further comprising a scissor mover configured to move the scissor mechanism between the first and second positions.

6. A powered transport apparatus configured to provide powered transport of a patient, the powered transport apparatus comprising a patient support including a support frame, a mattress, and at least four casters coupled to the support frame, a frame removably connectable to the patient support at a connection location that is accessible by the frame through at least one of the first and second longitudinal sides of the patient support, at least two casters coupled to the frame, and a powered wheel rotatably connected to the frame to provide powered transport of the patient support.

7. The powered transport apparatus of claim 6, wherein the frame is adapted to be positioned under the patient support.

8. The powered transport apparatus of claim 6, wherein the frame is adapted to be positioned below one of the first and second longitudinal sides when connected to the patient support.

9. The powered transport apparatus of claim 6, wherein the powered wheel is connected to the frame such that an axis of rotation of the powered wheel is substantially perpendicular to the first and seconds longitudinal sides of the patient support when the frame is connected to the patient support.

10. The powered transport apparatus of claim 6, wherein a longitudinal axis of the frame is adapted to be substantially perpendicular to the first and second longitudinal sides of the patient support when the frame is connected to the patient support.

11. The powered transport apparatus of claim 6, wherein the frame is adapted to be positioned at a midpoint between the head and foot ends of the patient support when connected to the patient support.

12. The powered transport apparatus of claim 6, further comprising a scissor mechanism adapted to transfer downward force from the patient support to the powered wheel, the scissor mechanism is movable between a first position transferring downward force from the patient support to the powered wheel and a second position permitting removal of the frame from the patient support.

13. The powered transport apparatus of claim 12, further comprising a scissor mover configured to move the scissor mechanism between the first and second positions.

14. A powered transport apparatus configured to provide powered transport of a patient support, the powered transport apparatus comprising:

a frame, a powered wheel, a scissor mechanism supported by the frame and movable between a first position supporting the patient support and a second position permitting removal of the frame from the patient support, the scissor mechanism including a first link and a second link coupled to the first link to rotate relative to the first link during movement of the scissor mechanism between the first and second positions, and a compliant member coupled to at least one of the first and second links of the scissor mechanism and the frame, and a connection member, supported by the scissor mechanism, to removably connect the powered transport apparatus to the patient support with contact pressure wherein the compliant member has a first state applying a first amount of force to the at least one of the first and second links and a second state applying a second amount of force to the at least one of the first and second links that is greater than the first amount.

15. The powered transport apparatus of claim 14, further comprising a member supported by the scissor mechanism and adapted to connect the scissor mechanism to the patient support.

16. The powered transport apparatus of claim 14, further comprising a shuttle slidably coupled to the frame and at least one of the first and second links of the of the scissor mechanism, the shuttle is configured to move the scissor mechanism between the first and second positions.

17. A powered transport apparatus configured to provide powered transport of a patient, the powered transport apparatus comprising a patient support including a support frame with at least two longitudinally extending members, a mattress, and at least four casters coupled to the support frame, a frame, at least two casters coupled to the frame, a powered wheel supported by the frame, and a substantially T-shaped connection member including a first member and a second member coupled to a midpoint of the first member, supported by the frame, to connect to the at least two longitudinally extending members of the patient support, the first member is adapted to be connected to the patient support in at least two spaced-apart locations and the second member is connected to the patient support in at least one location.

18. The powered transport apparatus of claim 17, further comprising a scissor mechanism movable between a first position supporting connection member in contact with the patient support and a second position permitting removal of the connection member from the patient support.

19. The powered transport apparatus of claim 18, further comprising a scissor mover configured to move the scissor mechanism between the first position and the second positions.

20. The powered transport apparatus of claim 18, wherein the scissor mechanism raises the connection member to the first position and lowers the connection member to the second position.

21. The powered transport apparatus of claim 17, wherein the frame is adapted to be positioned under a longitudinal side of the patient support.

22. The powered transport apparatus of claim 17, wherein the connection member has first and second ends and is pivotal supported at a location spaced apart from the first and second ends.

23. A powered transport apparatus configured to provide powered transport of a patient support, the patient support having a head end, a foot end longitudinally spaced apart from the head end, a first longitudinal side, and a second longitudinal side, the head and foot ends and the first and second longitudinal sides cooperating to define a footprint of the patient support, the powered transport apparatus comprising a frame including at least two casters, the frame adapted to enter the footprint of the patient support between the first and second ends of the patient support, a powered wheel rotatably supported by the frame to provide powered transport to the patient support, and a connection member supported by the frame and configured to removably connect the powered transport apparatus to the patient support with contact pressure.

24. The powered transport apparatus of claim 23, wherein the frame of the mover is adapted to be positioned under one of the first and second longitudinal sides of the patient support.

25. The powered transport apparatus of claim 23, further comprising a scissor mechanism adapted to transfer downward force to the frame from the patient support.

26. An apparatus configured to provide powered transport of a patient, the apparatus comprising a patient support including a frame, at least four casters, and a patient rest surface, the patient support defining a footprint having a head end, a foot end, and first and second spaced-apart longitudinal sides extending between the head and foot ends, and a powered transport apparatus configured to assist a caregiver in moving the patient support from one location to another, the powered transport apparatus including at least two casters and a powered wheel, the powered transport apparatus being removably connected to the patient support at a connection location that is accessible by the powered transport apparatus through one of the first and second longitudinal sides of the footprint.

27. The apparatus of claim 26, wherein the powered transport apparatus is positioned substantially within the footprint defined by the patient support when connected to the patient support.

28. The apparatus of claim 26, wherein the powered transport apparatus follows a path when being removably connected to the patient support and the path crosses at least one of the first and second longitudinal sides of the footprint.

29. The apparatus of claim 28, wherein the path crosses over a midpoint of at least one of the first and second longitudinal sides of the footprint.

30. The apparatus of claim 26, wherein in the powered transport is spaced apart from the head and foot ends of the footprint when removably connected to the patient support.

31. The apparatus of claim 30, wherein the powered transport is positioned over a midpoint of the footprint when removably connected to the patient support.

32. The apparatus of claim 26, wherein the powered transport apparatus includes a frame removably connected to the frame of the patient support and a powered wheel supported by the frame and configured to move the patient support.

33. The apparatus of claim 32, wherein the frame of the powered transport apparatus and the frame of the patient support are substantially perpendicular when removably connected.

34. The apparatus of claim 32, wherein the powered transport apparatus further includes a connection member supported by the frame of the powered transport apparatus, the frame of the patient support includes at least two longitudinally extending member, and the connection member of the powered transport apparatus is removably connected to the at least two longitudinally extending members of the patient support to removably connected the frame of the powered transport apparatus to the frame of the patient support.

35. The apparatus of claim 32, wherein the powered transport apparatus further includes a scissor mechanism adapted to transfer downward force from the patient support to the powered wheel, the scissor mechanism is movable between a first position transferring downward force from the patient support to the powered wheel and a second position permitting removal of the powered transport apparatus from the foot print defined by the patient support.

* * * * *